US012648680B2

(12) United States Patent
Kim et al.

(10) Patent No.: US 12,648,680 B2
(45) Date of Patent: Jun. 9, 2026

(54) ROBOTIC VACUUM CLEANER, DOCKING STATION, AND CLEANING SYSTEM INCLUDING THE SAME

(71) Applicant: SAMSUNG ELECTRONICS CO., LTD., Suwon-si (KR)

(72) Inventors: Elijah Kim, Suwon-si (KR); Sunghyun Kim, Suwon-si (KR); Juyeong Kim, Suwon-si (KR); Junwon Seo, Suwon-si (KR); Hongseok Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 563 days.

(21) Appl. No.: 18/205,022

(22) Filed: Jun. 2, 2023

(65) Prior Publication Data

US 2024/0041293 A1 Feb. 8, 2024

Related U.S. Application Data

(63) Continuation of application No. PCT/KR2023/006848, filed on May 19, 2023.

(30) Foreign Application Priority Data

Aug. 4, 2022 (KR) ..... 10-2022-0097418

(51) Int. Cl.
*A47L 11/40* (2006.01)
*A47L 11/282* (2006.01)

(52) U.S. Cl.
CPC ..... *A47L 11/4091* (2013.01); *A47L 11/282* (2013.01); *A47L 11/4011* (2013.01); (Continued)

(58) Field of Classification Search
CPC ..... A47L 11/4091; A47L 2201/02; A47L 2201/024; A47L 2201/022; A47L 2201/028
See application file for complete search history.

(56) References Cited

U.S. PATENT DOCUMENTS 10,993,598 B2 5/2021 Park et al.
11,019,975 B2 6/2021 Jang et al.
(Continued)

FOREIGN PATENT DOCUMENTS

JP 2018-82732 5/2018
JP 2020-099666 A 7/2020
(Continued)

OTHER PUBLICATIONS

International Search Report dated Aug. 2, 2023 in PCT Application No. PCT/KR2023/006848.
(Continued)

*Primary Examiner* — Shay Karls
(74) *Attorney, Agent, or Firm* — STAAS & HALSEY LLP

(57) ABSTRACT

A docking station including a docking unit providing a traveling path for a robotic vacuum cleaner, having a mounted mopping cloth, that enters the docking unit; a mopping cloth separator disposed on the docking unit and configured to automatically separate the mounted mopping cloth from the robotic vacuum cleaner while the robotic vacuum cleaner is at a first position along the traveling path; and a mopping cloth coupler disposed on the docking unit and configured so that, after the mounted mopping cloth is separated from the robotic vacuum cleaner, and the robotic vacuum cleaner thereafter moves to a second position along the traveling path, the mopping cloth coupler supplies a mopping cloth to be mounted to the robotic vacuum cleaner from below the traveling path while the robotic vacuum cleaner is at the second position.

20 Claims, 33 Drawing Sheets

(52) U.S. Cl.
CPC ..... *A47L 11/4038* (2013.01); *A47L 11/4066* (2013.01); *A47L 11/4069* (2013.01); *A47L 2201/022* (2013.01); *A47L 2201/028* (2013.01); *A47L 2201/04* (2013.01); *A47L 2201/06* (2013.01)

(56) References Cited

U.S. PATENT DOCUMENTS

| | | | |
|---|---|---|---|
| 11,051,671 | B2 | 7/2021 | Jang et al. |
| 11,116,377 | B2 | 9/2021 | Goto et al. |
| 11,523,726 | B2 | 12/2022 | Fang |
| 11,690,493 | B2 | 7/2023 | Weis et al. |
| 2005/0015913 | A1 | 1/2005 | Kim et al. |
| 2015/0182089 | A1 | 7/2015 | Jeong et al. |
| 2022/0142444 | A1 | 5/2022 | Xie et al. |
| 2022/0409001 | A1 | 12/2022 | Weis et al. |

FOREIGN PATENT DOCUMENTS

| | | | | | |
|---|---|---|---|---|---|
| JP | 2020-151476 | A | | 9/2020 | |
| JP | 2021-069645 | A | | 5/2021 | |
| JP | 7022137 | B2 | | 2/2022 | |
| KR | 20-1998-0013683 | | | 6/1998 | |
| KR | 10-2005-0012047 | A | | 1/2005 | |
| KR | 10-2010-0013362 | | | 2/2010 | |
| KR | 10-2013-0113167 | | | 10/2013 | |
| KR | 10-2015-0078093 | | | 7/2015 | |
| KR | 10-2016-0090571 | A | | 8/2016 | |
| KR | 20200052071 | A | * | 5/2020 | ..... A47L 11/10 |
| KR | 10-2021-0105908 | | | 8/2021 | |
| KR | 10-2022-0016627 | A | | 2/2022 | |
| KR | 10-2022-0020360 | | | 2/2022 | |
| KR | 10-2022-0020360 | A | | 2/2022 | |
| WO | WO 2018/116721 | A1 | | 6/2018 | |
| WO | WO 2020/125760 | A1 | | 6/2020 | |

OTHER PUBLICATIONS

Written Opinion dated Aug. 2, 2023 in PCT Application No. PCT/KR2023/006848.

* cited by examiner

ROBOTIC VACUUM CLEANER, DOCKING STATION, AND CLEANING SYSTEM INCLUDING THE SAME

CROSS-REFERENCE TO RELATED APPLICATIONS

This application is a continuation application of International Application No. PCT/KR2023/006848 designating the United States, filed on May 19, 2023, in the Korean Intellectual Property Receiving Office, which claims priority from Korean Patent Application No. 10-2022-0097418, filed on Aug. 4, 2022, in the Korean Intellectual Property Office, the disclosures all of which are hereby incorporated by reference herein in their entireties.

BACKGROUND

1. Field

Embodiments of the disclosure relate to a robotic vacuum cleaner capable of attaching a mop, a docking station providing automatic replacement of a mop attached to the robotic vacuum cleaner, and a cleaning system including the same.

2. Description of Related Art

A robotic vacuum cleaner is a device that automatically cleans a cleaning space while moving in the cleaning space without the user's manipulation. In general, a robotic vacuum cleaner may suck up a foreign object, such as dust accumulated on the surface to be cleaned (e.g., the floor), or wiping off a foreign object, such as dirt stuck on the surface to be cleaned, with a mopping cloth. Among these robotic vacuum cleaners, a type of robotic vacuum cleaners wipe off the foreign object stuck on the surface by rotating a mopping cloth attached thereto.

As cleaning proceeds, the mopping cloth attached to the robotic vacuum cleaner may be contaminated. For effective cleaning, the user needs to replace the contaminated mopping cloth.

SUMMARY

Aspects of embodiments of the disclosure will be set forth in part in the description which follows and, in part, will be apparent from the description, or may be learned by practice of the presented embodiments.

Embodiments of the disclosure may provide a docking station supporting replacement of a mopping cloth attached to a robotic vacuum cleaner to be used for cleaning and a robotic vacuum cleaner.

According to an embodiment of the disclosure, a docking station may include a docking unit providing a traveling path for a robotic vacuum cleaner, having a mounted mopping cloth, that enters the docking unit; a mopping cloth separator disposed on the docking unit and configured to automatically separate the mounted mopping cloth from the robotic vacuum cleaner while the robotic vacuum cleaner is at a first position along the traveling path; and a mopping cloth coupler disposed on the docking unit and configured so that, after the mounted mopping cloth is separated from the robotic vacuum cleaner, and the robotic vacuum cleaner thereafter moves to a second position along the traveling path, the mopping cloth coupler supplies a mopping cloth to be mounted to the robotic vacuum cleaner from below the traveling path while the robotic vacuum cleaner is at the second position.

According to an embodiment of the disclosure, the mounted mopping cloth and the mopping cloth supplied by the mopping cloth coupler each includes a hole, and the mopping cloth separator includes a separation structure configured to pass through the hole of the mounted mopping cloth mounted to the robotic vacuum cleaner, and apply a force to the mounted mopping cloth, against a force applied to the mounted mopping cloth from the robotic vacuum cleaner, to separate the mounted mopping cloth from the robotic vacuum cleaner, and a mopping cloth container recessed from an upper surface of the docking unit and configured to receive the separated mopping cloth, wherein the separation structure extends from a bottom surface of the mopping cloth container.

According to an embodiment of the disclosure, the separation structure is configured to maintain a state in which the separation structure is extended through the hole of the separated mopping cloth while the separated mopping cloth is received in the mopping cloth container.

According to an embodiment of the disclosure, the separation structure includes a body portion having at least a portion configured to pass through the hole of the mounted mopping cloth, and a pair of hooks connected to the body portion so as to be rotatable, wherein each of the hooks includes a connection portion connected to the body portion, and a free end opposite to the connection portion, wherein the free ends are configured to be rotated downward to approach each other to be folded in an inactive state when an external force is applied to the free ends toward the bottom surface of the mopping cloth container, and moved away from each other by an elastic force when the external force is removed, so as to be unfolded and restored to an active state.

According to an embodiment of the disclosure, the separation structure includes a button configured to adjust the pair of hooks to the active state or the inactive state, and when the pair of hooks are adjusted to the inactive state by manipulation of the button, the pair of hooks are configured to maintain the inactive state without application of an additional external force.

According to an embodiment of the disclosure, the separation structure includes a first body portion configured with a first thread formed on an upper outer circumferential surface, and a second body portion including a hollow portion configured with a second thread formed on an inner circumferential surface of the hollow portion, wherein at least part of the first body portion is inserted in the hollow portion of the second body portion so that the second thread is screwed onto the first thread.

According to an embodiment of the disclosure, the mopping cloth supplied by the mopping cloth coupler includes a coupling portion extending upward from the hole, the coupling portion has a polygonal shaped inner circumferential surface passing therethrough, and at least one of the mopping cloth separator and the mopping cloth coupler includes a polygonal shaped head portion corresponding to the polygonal shaped inner circumferential surface of the coupling portion such that at least a part of the polygonal shaped head portion is insertable into the coupling portion through the hole.

According to an embodiment of the disclosure, at least one of the mopping cloth separator and the mopping cloth coupler includes an elastic support configured to provide a vertical elastic force to the polygonal shaped head portion.

According to an embodiment of the disclosure, the mopping cloth coupler includes a receiving space recessed from an upper surface of the docking unit and configured so that one or more mopping cloths are stackable inside the receiving space, and a mopping cloth support disposed at a lower side of the receiving space and configured to push upward on the one or more mopping cloths in the receiving space.

According to an embodiment of the disclosure, the mopping cloth coupler includes a fixing member disposed on the upper surface of the docking unit and configured to limit an uppermost height of the one or more mopping cloths in the receiving space being pushed upward by the mopping cloth support.

According to an embodiment of the disclosure, a cleaning system may include a robotic vacuum cleaner including a mopping cloth unit to which a mopping cloth is mountable; and a docking station including a docking unit providing a traveling path for the robotic vacuum cleaner, having a mopping cloth mounted to the mopping cloth unit, that enters the docking unit; a mopping cloth separator disposed on the docking unit and configured to automatically separate the mopping cloth mounted to the mopping cloth unit while the robotic vacuum cleaner is at a first position along the traveling path; and a mopping cloth coupler disposed on the docking unit and configured so that, after the mopping cloth is separated from the mopping cloth unit, and the robotic vacuum cleaner thereafter moves to a second position along the traveling path, the mopping cloth coupler supplies a mopping cloth to be mounted to the mopping cloth unit from below the traveling path while the robotic vacuum cleaner is at the second position.

According to an embodiment of the disclosure, the mounted mopping cloth and the mopping cloth supplied by the mopping cloth coupler each includes a hole, and the mopping cloth separator includes a separation structure configured to pass through the hole of the mounted mopping cloth mounted to the robotic vacuum cleaner, and apply a force to the mounted mopping cloth, against a force applied to the mounted mopping cloth from the robotic vacuum cleaner, to separate the mounted mopping clot from the robotic vacuum cleaner, and a mopping cloth container recessed from an upper surface of the docking unit and configured to receive the separated mopping cloth, wherein the separation structure extends from a bottom surface of the mopping cloth container.

According to an embodiment of the disclosure, the force applied to the mounted mopping cloth from the robotic vacuum cleaner is generated by upward/downward movement or rotation of the mopping cloth unit.

According to an embodiment of the disclosure, the mopping cloth supplied by the mopping cloth coupler includes a coupling portion extending upward from the hole, the coupling portion has a polygonal shaped inner circumferential surface passing therethrough, and at least one of the mopping cloth separator and the mopping cloth coupler includes a polygonal shaped head portion corresponding to the polygonal shaped inner circumferential surface of the coupling portion such that at least a part of the polygonal shaped head portion is insertable into the coupling portion through the hole.

According to an embodiment of the disclosure, the coupling portion includes a thread formed on an outer circumferential surface, and the mopping cloth unit is configured to be rotatable and includes a mopping cloth fastening portion provided with an inner circumferential surface having a thread corresponding to the thread of the coupling portion so that the mopping cloth fastening portion is couplable to the coupling portion.

According to an embodiment of the disclosure, the mopping cloth separator and the mopping cloth unit are configured so that, when the robotic vacuum cleaner is at the first position along the traveling path, the head portion of the mopping cloth separator is insertable into the hole of the mounted mopping cloth, and the mopping cloth unit is rotatable in a first rotation direction so as to release engagement between the coupling portion of the mopping cloth and the mopping cloth fastening portion, and the mopping cloth coupler and the mopping cloth unit are configured so that, when the robotic vacuum cleaner is at the second position along the traveling path after having the mounted mopping cloth separated from the robot vacuum cleaner at the first position along the traveling path, the head portion of the mopping cloth coupler is insertable into the hole of the mopping cloth supplied by the mopping cloth coupler, and the mopping cloth unit is rotatable in a second rotation direction opposite to the first rotation direction to engage the coupling portion of a mopping cloth in the mopping cloth coupler with the mopping cloth fastening portion.

According to an embodiment of the disclosure, a robotic vacuum cleaner may include a mopping cloth unit configured to mount a mopping cloth to the mopping cloth unit; a replacement determination unit configured to determine whether it is a time to replace a mopping cloth mounted to the mopping cloth unit; a travel driving unit configured to drive the robotic vacuum cleaner to travel along a traveling path; a rotate driving unit configured to rotate the mopping cloth unit; an up/down driving unit configured to move the mopping cloth unit upward/downward; and a controller configured to, while a mopping cloth is mounted to the mopping cloth unit, upon determining by the replacement determination unit that it is the time to replace the mopping cloth mounted to the mopping cloth unit, control the travel driving unit to move the robotic vacuum cleaner to a first position along the traveling path, control at least one of the rotate driving unit and the up/down driving unit while the robotic vacuum cleaner is in the first position to separate the mopping cloth mounted to the mopping cloth unit from the mopping cloth unit, after the mopping cloth is separated from the mopping cloth unit, control the traveling driving unit to move the robotic vacuum cleaner to a second position along the traveling path, and control at least one of the rotate driving unit and the up/down driving unit while the robotic vacuum cleaner is in the second position to mount another mopping cloth to the mopping cloth unit, wherein, to travel to the first position, the robotic vacuum cleaner travels through the second position.

According to an embodiment of the disclosure, the mopping cloth mounted to the mopping cloth unit and the another mopping cloth each includes a hole, and the controller is configured to, upon detecting arrival of the robotic vacuum cleaner at the first position, control the up/down driving unit to move the mopping cloth unit downward so that at least a portion of a structure installed in the first position passes through the hole of the mopping cloth mounted to the mopping cloth unit, and then move the mopping cloth unit upward to separate the mopping cloth mounted to the mopping cloth unit from the mopping cloth unit, and upon detecting arrival of the robotic vacuum cleaner at the second position after having the mounted mopping cloth separated from the mopping cloth unit, control the up/down driving unit to move the mopping cloth unit downward by a predetermined distance so as to mount the another mopping cloth on the mopping cloth unit.

According to an embodiment of the disclosure, the mopping cloth mounted to the mopping cloth unit and the another mopping cloth each includes a hole and a coupling portion extending upward from the hole, the coupling portion has an outer circumferential surface with a thread formed thereon, the mopping cloth unit includes a mopping cloth fastening portion having a hollow cylindrical shape with an inner circumferential surface with a thread formed thereon and corresponding to the outer circumferential surface of the coupling portion of the mopping cloth, and the controller is configured to, upon detecting arrival of the robotic vacuum cleaner at the first position, control the rotate driving unit to rotate the mopping cloth unit in a second rotation direction to disengage the mopping cloth unit from the mopping cloth mounted on the mopping cloth unit, and upon detecting arrival of the robotic vacuum cleaner at the second position after having the mounted mopping cloth separated from the mopping cloth unit, control the rotate driving unit to rotate the mopping cloth unit in a first rotation direction opposite to the second rotation direction to engage the mopping cloth unit to the another mopping cloth.

According to an embodiment of the disclosure, the robotic vacuum cleaner further includes a charging terminal, wherein the controller is configured to control charging of the robotic vacuum cleaner through the charging terminal while the robotic vacuum cleaner is in the first position.

According to an embodiment of the disclosure, as the mopping cloth attached to the robotic vacuum cleaner is automatically replaced by the docking station rather than directly by the user, user convenience may be enhanced.

The technical objects of the disclosure are not limited to the foregoing, and other technical objects may be derived by one of ordinary skill in the art from example embodiments of the disclosure.

Effects of the present invention are not limited to the foregoing, and other unmentioned effects would be apparent to one of ordinary skill in the art from the following description. In other words, unintended effects in practicing embodiments of the disclosure may also be derived by one of ordinary skill in the art from the embodiments of the disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1:
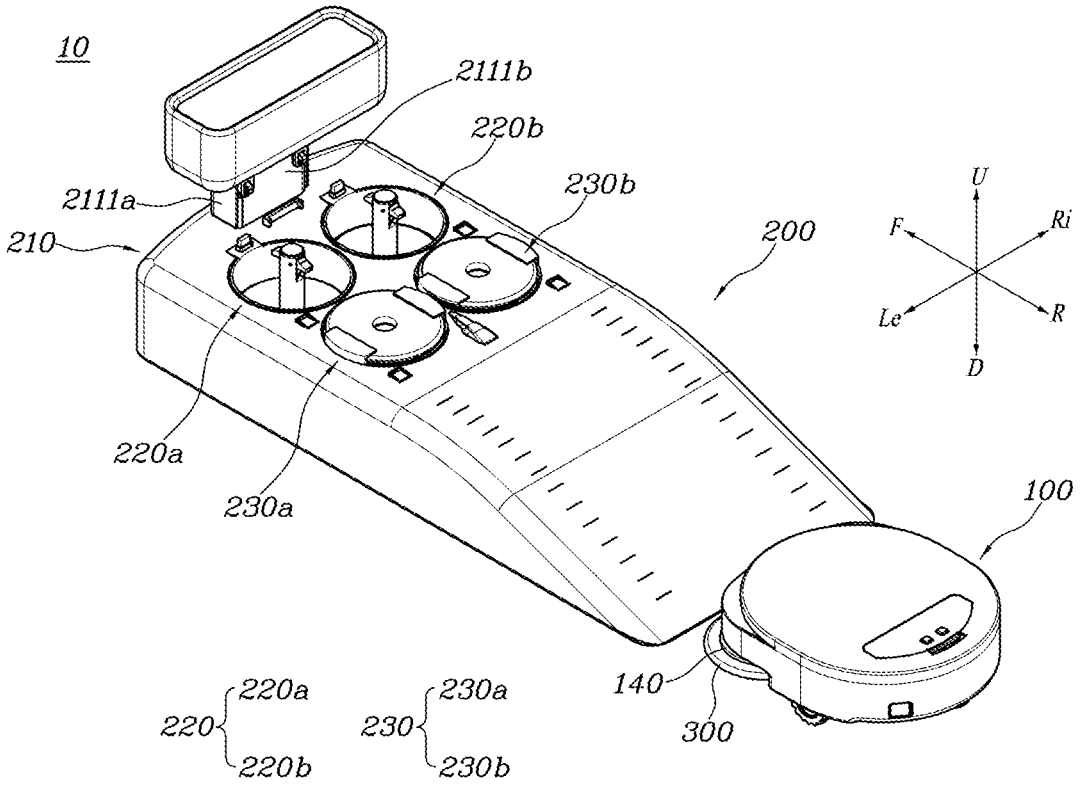
FIG. 1 is a view schematically illustrating a cleaning system according to an embodiment of the disclosure.

Embodiments of the present invention are now described with reference to the accompanying drawings in such a detailed manner as to be easily practiced by one of ordinary skill in the art. However, the present invention may be implemented in other various forms and is not limited to the embodiments set forth herein. The same or similar reference denotations may be used to refer to the same or similar elements throughout the specification and the drawings. Further, for clarity and brevity, no description is made of well-known functions and configurations in the drawings and relevant descriptions.

FIG. 1 is a view schematically illustrating a cleaning system according to an embodiment.

Referring to FIG. 1, a cleaning system 10 according to an embodiment may include a robotic vacuum cleaner 100 and a docking station 200. Referring to FIG. 1, in an embodiment, the docking station 200 may include a mopping cloth separator 220 having a hook structure and a mopping cloth coupler 230 having a push-up attaching structure.

In an embodiment, the robotic vacuum cleaner 100 may be in a state in which a mopping cloth 300 (wet mopping cloth or dry mopping cloth) contactable to the surface to be cleaned (e.g., floor) is attached to mopping cloth units 140 at the underside of the robotic vacuum cleaner 100. The robotic vacuum cleaner 100 may perform the operation (or mopping) of removing the foreign object stuck to the surface to be cleaned, by the mopping cloth 300 attached to the mopping cloth units 140 at the underside of the robotic vacuum cleaner 100. For example, the robotic vacuum cleaner 100 may remove the foreign object stuck to the floor by the frictional force between the floor and the mopping cloth 300, created as the mopping cloth 300 attached underneath is rotated.

The robotic vacuum cleaner 100 may enter the docking station 200 to replace the mopping cloth 300 attached to the mopping cloth units 140. The robotic vacuum cleaner 100 may enter the docking station 200 to charge the battery (e.g., the battery 150 of FIG. 3). The specific configuration and operation of the robotic vacuum cleaner 100 are described below with reference to FIGS. 2 to 4.

In an embodiment, the docking station 200 may include a station housing 210 that forms the overall appearance of the docking station 200. In an embodiment, the docking station 200 may include mopping cloth separators 220*a* and 220*b* that support to remove the mopping cloth 300 attached to the mopping cloth units 140 of the robotic vacuum cleaner 100 without a human intervention. In an embodiment, the docking station 200 may include mopping cloth couplers 230*a* and 230*b* that support to attach a new mopping cloth to the mopping cloth unit 140 of the robotic vacuum cleaner 100 without a human intervention. As shown, according to an embodiment, the mopping cloth separator 220 of the docking station 200 may be positioned downstream of the mopping cloth coupler 230 with respect to the traveling path of the robotic vacuum cleaner 100 entering the docking station 200 (i.e., upstream with respect to the traveling path of the robotic vacuum cleaner 100 exiting the docking station 200). The docking station 200 may be configured to include a pair of charging terminals 2111*a* and 2111*b* for charging the battery 150 disposed in the robotic vacuum cleaner 100. The specific configuration and operation of the docking station 200 are described below with reference to FIGS. 5 to 12.

Figure 2:
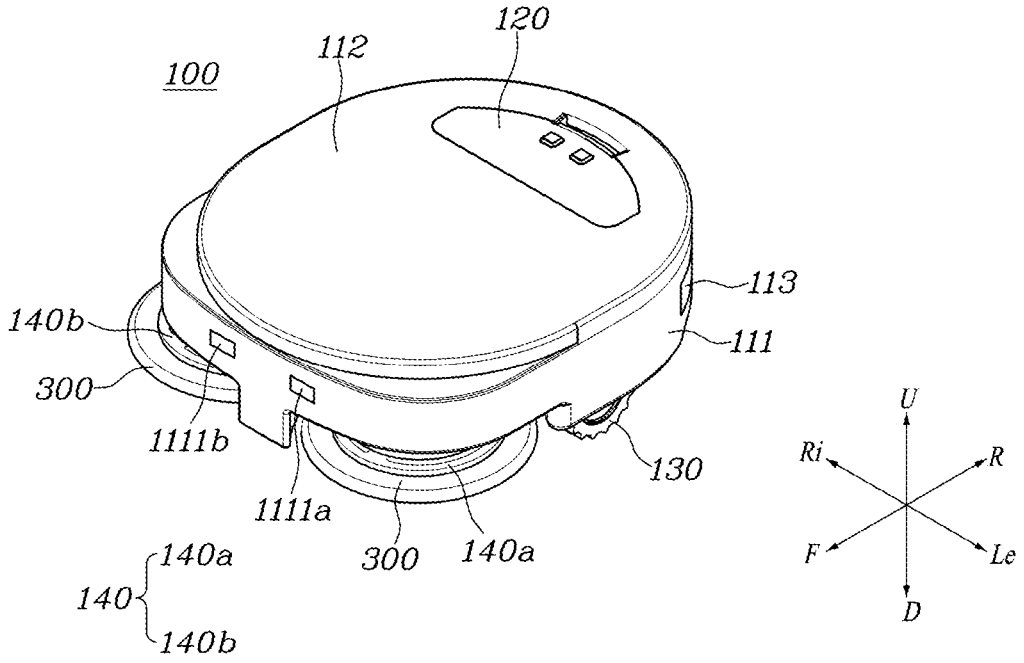
FIG. 2 is a perspective view illustrating a robotic vacuum cleaner according to an embodiment of the disclosure.
Figure 3:
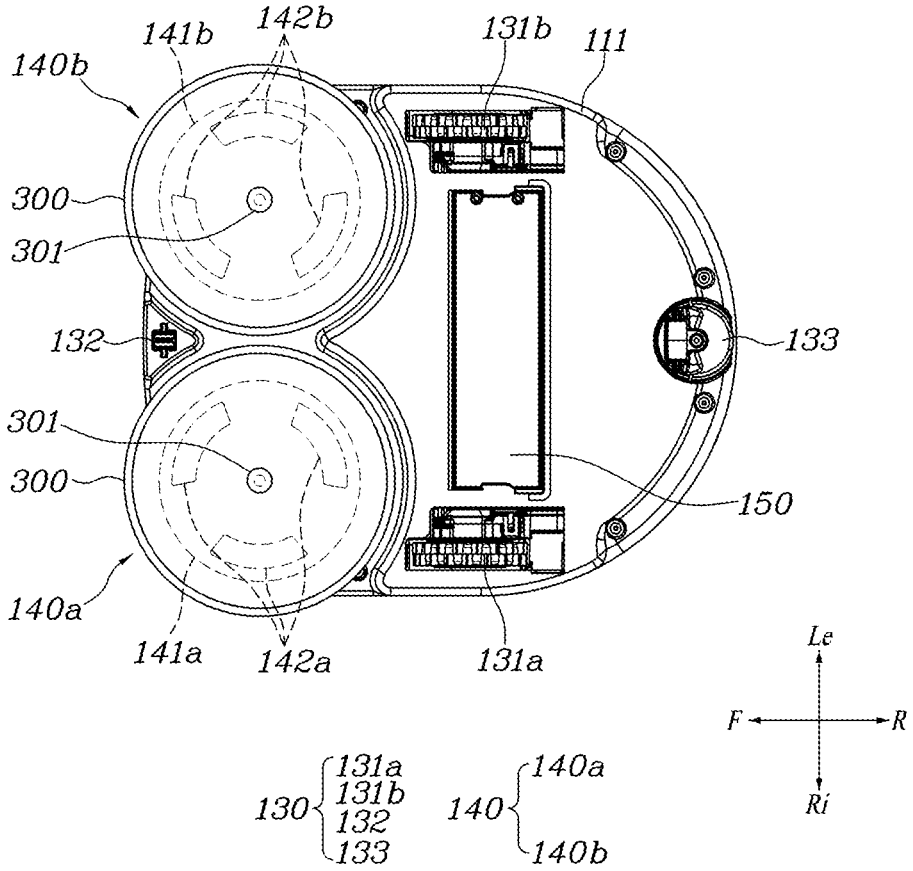
FIG. 3 is a bottom view illustrating a robotic vacuum cleaner according to an embodiment of the disclosure.

FIG. 2 is a perspective view illustrating a robotic vacuum cleaner according to an embodiment. FIG. 3 is a bottom view illustrating a robotic vacuum cleaner according to an embodiment.

Referring to FIGS. 2 and 3, in an embodiment, the robotic vacuum cleaner 100 may include a cleaner body 111 and a cleaner cover 112. In an embodiment, the cleaner body 111 may form the lower and/or side appearance of the robotic vacuum cleaner 100. According to an embodiment, a power button 113 may be disposed on one side of the cleaner body 111. According to an embodiment, the power button 113 may be manipulated for on/off by the user to power on/off the robotic vacuum cleaner 100. The cleaner cover 112 may form the upper appearance of the robotic vacuum cleaner 100. The cleaner cover 112 may be coupled to an upper side of the cleaner body 111.

In an embodiment, the robotic vacuum cleaner 100 may include a control panel 120 disposed on an upper surface of the cleaner cover 112. The control panel 120 may receive various commands regarding the operation of the robotic vacuum cleaner 100 from the user. According to an embodiment, the control panel 120 may provide the current status regarding the operation of the robotic vacuum cleaner 100 to the user.

According to an embodiment, the control panel 120 may include an input device, such as a button, a switch, or a touch panel. According to an embodiment, the robotic vacuum cleaner 100 may receive commands (e.g., start/stop cleaning or switch cleaning modes) regarding the operation of the robotic vacuum cleaner 100 from the user through the input device of the control panel 120.

According to an embodiment, the control panel 120 may include a display device such as a display. According to an embodiment, the robotic vacuum cleaner 100 may display, to the user, information (e.g., current cleaning mode or battery status) regarding the current status of the robotic vacuum cleaner 100 through the display device of the control panel 120. According to an embodiment, the control panel 120 may have an input device and a display device integrated together, but the disclosure is not limited thereto.

Referring to FIG. 3, in an embodiment, a driving unit 130 may be disposed on the lower surface of the cleaner body 111. The robotic vacuum cleaner 100 may move in the cleaning space through the driving unit 130. The driving unit 130 may be configured to allow the robotic vacuum cleaner 100 to freely move.

The driving unit 130 may include one or more wheels that rotate by receiving power from a driving unit (not shown) provided inside the robotic vacuum cleaner 100.

According to an embodiment, the driving unit 130 may include a pair of main wheels (i.e., a first main wheel 131*a* and a second main wheel 131*b*). In an embodiment, the first main wheel 131*a* and the second main wheel 131*b* may be disposed to support while balancing the body of the robotic vacuum cleaner 100 at two opposite edges of the lower surface of the cleaner body 111.

According to an embodiment, the driving unit 130 may include a first sub wheel 132 and a second sub wheel 133. In an embodiment, the first sub wheel 132 and the second sub wheel 133, respectively, may be disposed at the front (e.g., in the F direction) and rear (e.g., in the R direction) in a direction perpendicular to the direction in which the first main wheel 131*a* and the second main wheel 131*b* are disposed.

In an embodiment, the traveling direction of the robotic vacuum cleaner 100 may be determined depending on how the movement of each of the first main wheel 131*a* and second main wheel 131*b* is controlled. For example, when the first and second main wheels 131*a* and 131*b* are controlled to rotate at the same speed in the same direction, the robotic vacuum cleaner 100 may move forward or rearward. For example, when the pair of main wheels 131*a* and 131*b* are controlled to rotate in different directions and/or at different speeds, the robotic vacuum cleaner 100 may change the moving direction and move as determined.

In an embodiment, the first sub wheel 132 may be disposed forward (e.g., F direction) on the lower surface of the cleaner body 111. In an embodiment, the second sub wheel 133 may be disposed rearward (e.g., R direction) on the lower surface of the cleaner body 111. In an embodiment, the first sub wheel 132 and the second sub wheel 133 may support the robotic vacuum cleaner 100 to balance the robotic vacuum cleaner 100 when moving forward or rearward.

In an embodiment, the mopping cloth units 140 may be disposed on the lower surface of the cleaner body 111. In an embodiment, the mopping cloth units 140 may be disposed forward (e.g., F direction) on the lower surface of the cleaner body 111, but the disclosure is not limited thereto. A mopping cloth 300 (wet mopping cloth or dry mopping cloth) may be detachably coupled to the mopping cloth units 140 to wipe off the floor.

The mopping cloth units 140, together with the mopping cloth 300 attached to the mopping cloth units 140, may rotate clockwise or counterclockwise. When the mopping cloth units 140 are rotated along with the mopping cloth 300 attached thereto, friction may occur between the mopping cloth 300 and the floor. Thus, the robotic vacuum cleaner 100 may remove the foreign object stuck to the floor.

In an embodiment, the mopping cloth units 140 may ascend or descend within a predetermined distance range in the height direction of the robotic vacuum cleaner 100 (e.g., direction perpendicular to the ground or cleaning surface under the robotic vacuum cleaner 100).

In an embodiment, the mopping cloth units 140 may include a first mopping cloth unit 140*a* and a second mopping cloth unit 140*b*. The first mopping cloth unit 140*a* and the second mopping cloth unit 140*b* may correspond to each other in operation, structure, and shape. In an embodiment, the mopping cloth units 140 (e.g., the first mopping cloth unit 140*a* and the second mopping cloth unit 140*b*) may include a rotating plate (e.g., a first rotating plate 141*a* or a second rotating plate 141*b*) and an attaching member (e.g., a first attaching member 142*a* or a second attaching member 142*b*). In FIG. 2, the rotating plates 141*a* and 141*b* and the attaching members 142*a* and 142*b* are hidden by the mopping cloth 300 attached to the mopping cloth units 140 and, to represent the state, the rotating plates 141*a* and 141*b* and the attaching members 142*a* and 142*b* are shown in dashed lines.

In an embodiment, the first and second rotating plates 141*a* and 141*b* may overall have a disc shape. However, embodiments of the disclosure are not limited thereto. According to an embodiment, the diameter of the first rotating plate 141*a* may be set to be equal to or smaller than the diameter of the mopping cloth 300, but is not limited thereto. Likewise, the diameter of the second rotating plate 141*b* may be set to be equal to or smaller than the diameter of the mopping cloth 300, but is not limited thereto.

Each corresponding attaching member, e.g., the first attaching member 142*a* or the second attaching member 142*b*, may be disposed on one surface of each of the first rotating plate 141*a* and the second rotating plate 141*b*. In an embodiment, the mopping cloth 300 may be attached to each corresponding rotating plate 141*a* or 141*b* by the first or second attaching member 142*a* or 142*b*. The first or second attaching member 142*a* or 142*b* may be, e.g., a Velcro-type attaching means, but the disclosure is not limited thereto. According to an embodiment, the first or second attaching member 142*a* or 142*b* may be divided into a plurality of segments, but the disclosure is not limited thereto. In an embodiment, the first or second attaching member 142*a* or 142*b* may be constituted of a plurality of segments spaced apart from each other by a predetermined interval along the circumferential direction at the edge of the rotating plate 141*a* or 141*b*.

In an embodiment, the battery 150 may be disposed at the underside of the robotic vacuum cleaner 100. In an embodiment, the battery 150 may be provided to be detachable through the underside at the lower surface of the cleaner body 111. The battery 150 may be electrically connected with a driving unit, such as a motor, for transferring power to the driving unit 130 and/or the mopping cloth units 140 and supply power to the driving unit. The battery 150 may be a rechargeable secondary battery, but is not limited thereto. According to an embodiment, when charging terminals, e.g., a first charging terminal 1111*a* and/or a second charging terminal 1111*b*, provided on the front surface of the robotic vacuum cleaner 100 contact charging terminals, e.g., a first charging terminal 2111*a* and/or a second charging terminal 2111*b*, provided in the main body unit 211 of the docking station 200 described below, the battery 150 may receive power from the docking station 200 and be charged. In the drawings and the description, although the battery 150 is described and illustrated as being charged through contact charging, the disclosure is not limited thereto. According to an embodiment, the battery 150 may be charged by wireless charging, such as magnetic induction. In this case, a wireless charging structure (not shown) for wireless charging may be provided in each of the robotic vacuum cleaner 100 and the docking station 200.

Although not shown in FIGS. 2 and 3, a driving unit (e.g., the driving unit 180 of FIG. 4) may be provided in the robotic vacuum cleaner 100. In an embodiment, although not specifically illustrated, the driving unit may include a plurality of components, including a motor and/or an actuator, to supply power to the above-described traveling unit 130 or mopping cloth unit 140. In an embodiment, the driving unit may be connected to the above-described traveling unit 130, e.g., each of the first and second main wheels 131*a* and 131*b*, to provide power necessary to move the robotic vacuum cleaner 100. In an embodiment, the driving unit may be connected to the mopping cloth unit 140 to provide power necessary to rotate each rotating plate 141*a* or 141*b*. In an embodiment, the driving unit may be connected to the mopping cloth unit 140 to provide power necessary to ascend and/or descend in the height direction (or direction perpendicular to the ground) of the mopping cloth unit 140.

Although not shown in FIGS. 2 and 3, the robotic vacuum cleaner 100 may include a controller (e.g., the controller 170 of FIG. 4) to generate control commands for controlling the operation of each unit of the robotic vacuum cleaner 100. The control function by the controller according to an embodiment is briefly described with reference to FIG. 4.

Figure 4:
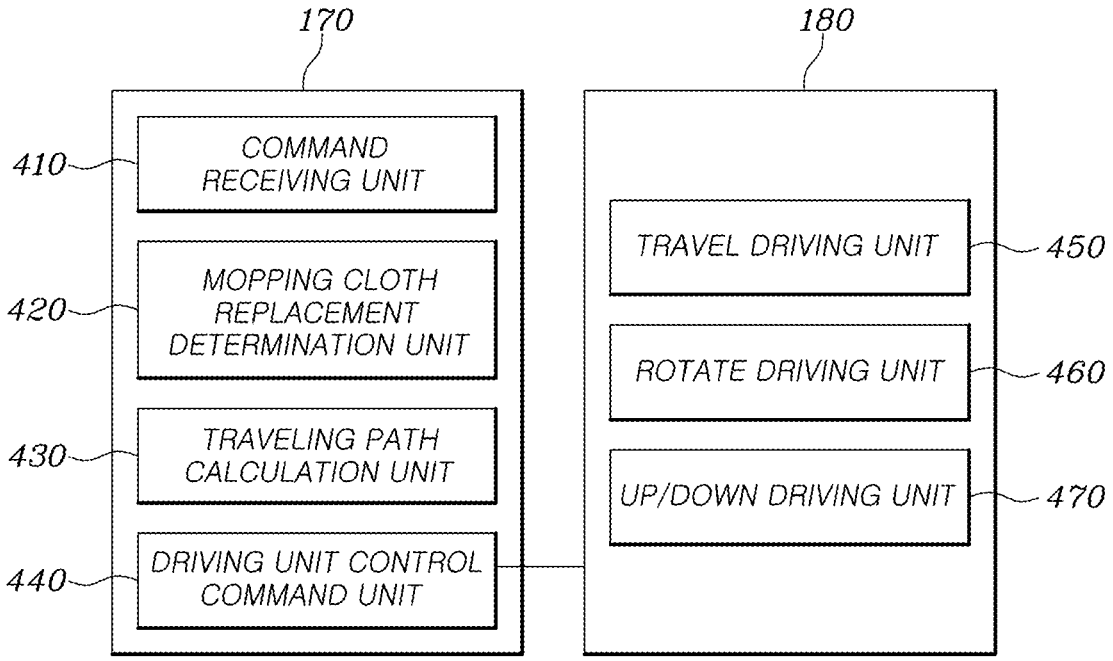
FIG. 4 is a view schematically illustrating functional blocks constituting a controller of a robotic vacuum cleaner according to an embodiment of the disclosure.

FIG. 4 is a view schematically illustrating functional blocks constituting a controller of a robotic vacuum cleaner according to an embodiment.

According to an embodiment, the controller 170 may include a command receiving unit 410. The command receiving unit 410 may receive commands from the user. The command receiving unit 410 may receive the command from the user, received through the above-described power button 113 and/or the control panel 120. The command receiving unit 410 may receive each user command including operation on/off command, cleaning start or pause command, or cleaning mode setting command.

In an embodiment, the controller 170 may include a mopping cloth replacement determination unit 420 to determine whether to replace the mopping cloth attached to the mopping cloth unit 140 while cleaning. In an embodiment, the mopping cloth replacement determination unit 420 may determine whether mopping cloth replacement is required depending on a result of detection by a separate contamination sensor (not shown) provided. In an embodiment, the mopping cloth replacement determination unit 420 man determine whether mopping cloth replacement is required according to the elapse of cleaning time after the mopping cloth is attached to the mopping cloth unit 140. In an embodiment, the mopping cloth replacement determination unit 420 may determine whether mopping cloth replacement is required according to the command received from the command receiving unit 410.

In an embodiment, the controller 170 may include a traveling path calculation unit 430 to calculate the traveling path of the robotic vacuum cleaner 100. In an embodiment, the traveling path calculation unit 430 may calculate the traveling path of the robotic vacuum cleaner 100 based on a predetermined algorithm, sensing results detected by various sensors (not shown) provided in the robotic vacuum cleaner 100, and/or the user command received through the command receiving unit 410. In an embodiment, the traveling path calculation unit 430 may calculate the traveling path considering the result of detection from the sensor (not shown) provided in the robotic vacuum cleaner 100. In an embodiment, when the mopping cloth replacement determination unit 420 determines that the mopping cloth needs to be replaced, the traveling path calculation unit 430 may calculate the traveling path to allow the robotic vacuum cleaner 100 to travel to the docking station 200. In an embodiment, when the battery 150 is determined to need to be charged, the traveling path calculation unit 430 may calculate the traveling path to allow the robotic vacuum cleaner 100 to travel to the docking station 200.

In an embodiment, the controller 170 may include a driving unit control command unit 440. In an embodiment, the driving unit control command unit 440 may generate control commands to control each component, e.g., motor and/or actuator, of the driving unit 180 of the robotic vacuum cleaner 100 according to the commands received from the user through the above-described command receiving unit 410, the sensing results detected by various sensors (not shown) provided in the robotic vacuum cleaner 100, and/or the traveling path determined by the traveling path calculation unit 430. In an embodiment, the driving unit 180 of the robotic vacuum cleaner 100 may include a plurality of components that control the movement of the driving unit 130 and the mopping cloth unit 140.

In an embodiment, each component of the driving unit 180 may be operated according to the command generated by the driving unit control command unit 440. According to an embodiment, the driving unit 180 may include a travel driving unit 450, a rotate driving unit 460, and an up/down driving unit 470.

In an embodiment, the travel/movement of the robotic vacuum cleaner 100 may be controlled according to the command generated by the driving unit control command unit 440. In an embodiment, each component of the driving unit (e.g., the travel driving unit 450) may be operated to properly control the rotating direction and speed of the first and second main wheels 131*a* and 131*b* according to the command generated by the driving unit control command unit 440, thereby allowing the robotic vacuum cleaner 100 to properly move in a required direction.

In an embodiment, the rotation and/or vertical movement of the mopping cloth unit 140 may be controlled according to the command generated by the driving unit control command unit 440. In an embodiment, the driving unit control command unit 440 may generate the control command for controlling each component, e.g., motor and/or actuator, of the driving unit (e.g., the rotate driving unit 460 or up/down driving unit 470) to allow the mopping cloth unit 140 to move based on the command received from the user through the above-described command receiving unit 410 and/or a pre-stored algorithm.

In an embodiment, each component of the driving unit (e.g., the rotate driving unit 460) may be operated to properly adjust the rotating speed of each rotating plate 141*a* or 141*b* according to the command generated by the driving unit control command unit 440. In this case, the wet mopping strength of the robotic vacuum cleaner 100 may be adjusted. In an embodiment, each component of the driving unit (e.g., the up/down driving unit 470) may adjust the mopping cloth unit 140 to ascend or descend in the height direction according to the command generated by the driving unit control command unit 440. In this case, the distance between the mopping cloth unit 140 and the floor may be adjusted.

Figure 5:
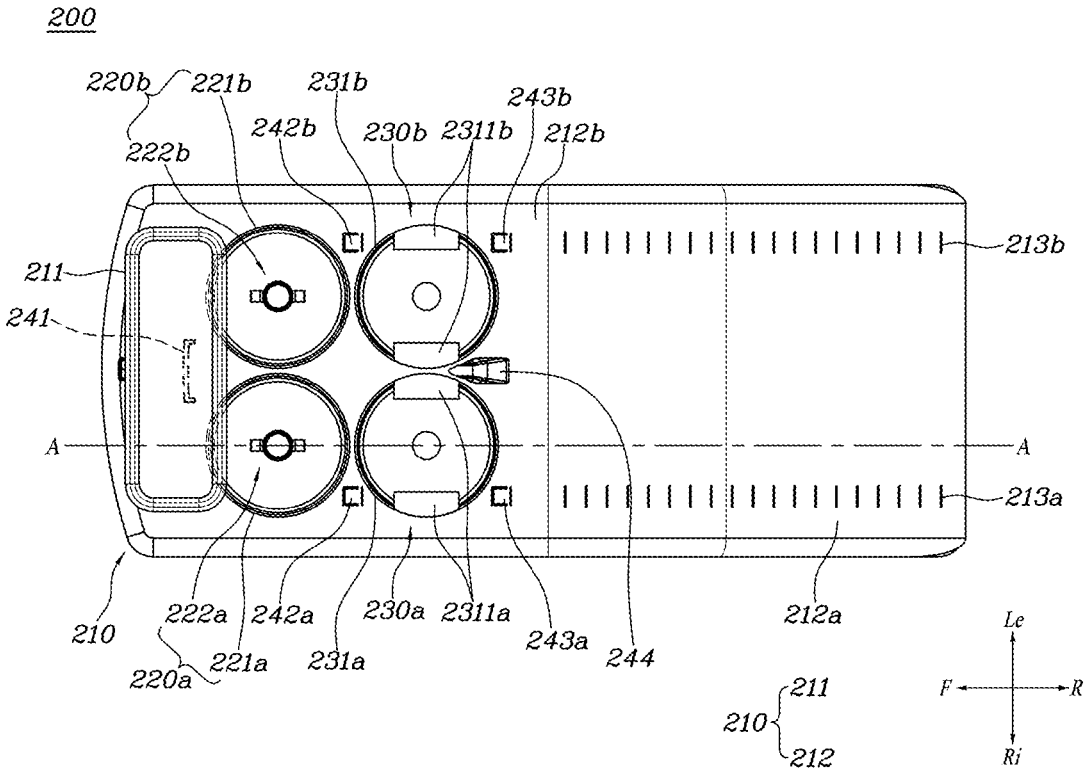
FIG. 5 is a plan view illustrating a docking station according to an embodiment of the disclosure.
Figure 6:
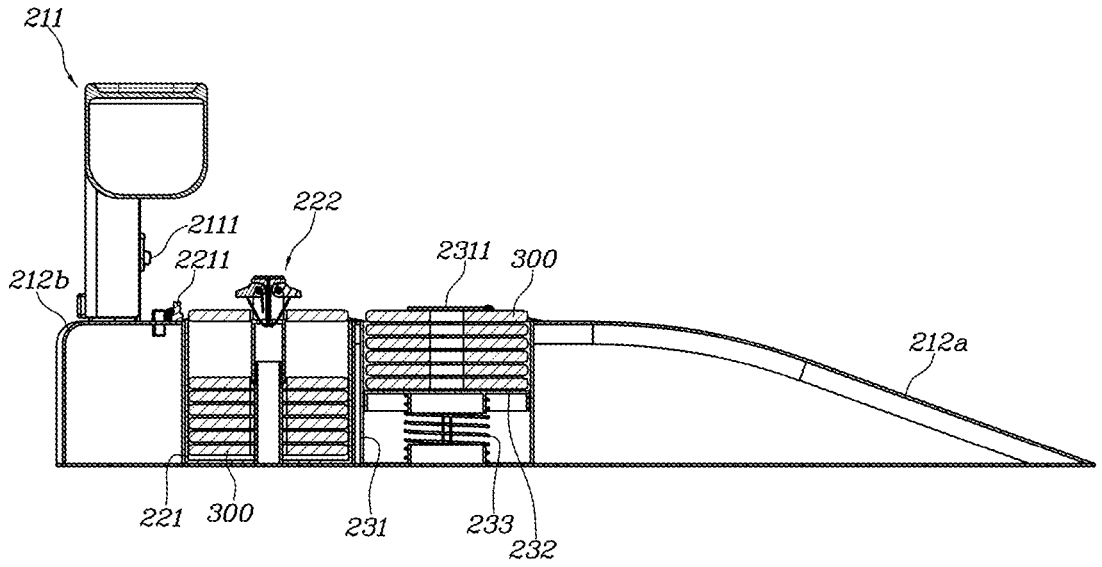
FIG. 6 is a cross-sectional view of a docking station taken along line A-A of FIG. 5 according to an embodiment of the disclosure.

FIG. 5 is a plan view illustrating a docking station according to an embodiment. FIG. 6 is a cross-sectional view of a docking station taken along line A-A of FIG. 5 according to an embodiment.

Referring to FIGS. 5 and 6, in an embodiment, the docking station 200 may include a station housing 210. According to an embodiment, the station housing 210 may form the overall appearance of the docking station 200. According to an embodiment, the station housing 210 may include a main body unit 211 and a docking unit 212.

In an embodiment, the docking unit 212 may be a component that forms a lower portion of the station housing 210. In an embodiment, the docking portion 212 may include a first portion 212*a* and a second portion 212*b* continuing from the first portion 212*a*.

According to an embodiment, the first portion 212*a* and the second portion 212*b* of the docking unit 212 may provide a travel path for the cleaner 100 approaching the docking station 200. According to an embodiment, a traveling trajectory for the robotic vacuum cleaner 100 entering the docking station 200 to charge the battery 150 or replace the mopping cloth 300, e.g., a traveling surface where the pair of main wheels 131 provided in the robotic vacuum cleaner 100 pass, may be formed on the upper surface of the first portion 212*a* and the second portion 212*b*. According to an embodiment, a traveling trajectory for the robotic vacuum cleaner 100 exiting the docking station 200 after the charging of the battery 150 and/or replacement of the mopping cloth 300 is completed, i.e., the traveling surface where the pair of main wheels 131 provided in the robotic vacuum cleaner 100 pass, may be formed on the upper surface of the first portion 212*a* and the second portion 212*b*.

According to an embodiment, the first portion 212*a* may be positioned upstream of the second portion 212*b* with respect to the traveling path of the robotic vacuum cleaner 100 entering the docking station 200. According to an embodiment, the upper surface of the first portion 212*a* may provide the front portion of the traveling path of the robotic vacuum cleaner 100 entering the docking station 200.

In an embodiment, the second portion 212*b* may be positioned downstream of the first portion 212*a* on the travel path of the robotic vacuum cleaner 100 entering the docking station 200. According to an embodiment, the upper surface of the second portion 212*b* may provide the rear portion of the traveling path of the robotic vacuum cleaner 100 entering the docking station 200.

According to an embodiment, the first portion 212*a* may include a ramp, but is not limited thereto. In an embodiment, the first portion 212*a* may form an inclined surface that gradually ascends along the direction (e.g., F direction) in which the robotic vacuum cleaner 100 enters the docking station 200. In an embodiment, the second portion 212*b* continuing from the first portion 212*a* may form a flat surface without an inclination. In an embodiment, the flat surface of the second portion 212*b* may be disposed on top of the inclined surface formed by the first portion 212*a*.

According to an embodiment, the first portion 212*a* may have anti-slip members 213*a* and 213*b*. In an embodiment, the anti-slip members 213*a* and 213*b* may be disposed at the edges of left and right side ends of the first portion 212*a*. In an embodiment, the anti-slip member 213*a* or 213*b* may be disposed in the position corresponding to the traveling trajectory of the robotic vacuum cleaner 100. According to an embodiment, there may be provided a plurality of anti-slip members 213*a* and 213*b*. In an embodiment, the anti-slip members 213*a* and 213*b* may be disposed to be spaced apart from each other by a predetermined interval along the direction in which the inclination of the first portion 212*a* proceeds (or the traveling direction (e.g., F or R direction) of the robotic vacuum cleaner 100). According to an embodiment, the anti-slip members 213*a* and 213*b* may be configured to prevent a slip of the robotic vacuum cleaner 100 moving along the first portion 212*a*. The anti-slip members 213*a* and 213*b* may be formed of, e.g., rubber.

According to an embodiment, a first mopping cloth separator 220*a* and a second mopping cloth separator 220*b* may be disposed side by side on the second portion 212*b* of the docking unit 212.

According to an embodiment, the first mopping cloth separator 220*a* and the second mopping cloth separator 220*b* each may include a post-use mopping cloth receiving space recessed downward from the upper surface of the second portion 212*b*. According to an embodiment, each of the mopping cloths 300 separated from the robotic vacuum cleaner 100 from the first mopping cloth separator 220*a* and the second mopping cloth separator 220*b* may be received in its respective corresponding post-use mopping cloth receiving space. According to an embodiment, the first mopping cloth separator 220*a* and the second mopping cloth separator 220*b* may include a first post-use mopping cloth container 221 or a second post-use mopping cloth container 221*b* received in their respective corresponding post-use mopping cloth receiving spaces. According to an embodiment, each of the first or second post-use mopping cloth container 221*a* or 221*b* may be shaped as an empty cylinder with a top opening, but the disclosure is not limited thereto.

According to an embodiment, the first or second post-use mopping cloth container 221*a* or 221*b* each may receive one or more mopping cloths 300 separated from the robotic vacuum cleaner 100. In an embodiment, a plurality of mopping cloths 300 separated from the robotic vacuum cleaner 100 may be vertically stacked inside the first or second post-use mopping cloth container 221*a* or 221*b*.

According to an embodiment, each of the first or second post-use mopping cloth container 221*a* or 221*b* may have a container handle 2211 protruding upward from the top edge of each post-use mopping cloth container 221*a* or 221*b*. According to an embodiment, the container handle 2211 may be provided to be gripped by the user.

According to an embodiment, the first or second post-use mopping cloth container 221*a* or 221*b* may be disposed to be separable from the docking station 200. In this case, the user may separate each container 221*a* or 221*b* from the docking station 200 by holding the container handle 2211 provided in each post-use mopping cloth container 221*a* or 221*b* and lifting each corresponding post-use mopping cloth container 221*a* or 221*b*. The user may easily collect the mopping cloth 300 received in each post-use mopping cloth container 221*a* or 221*b* by separating each mopping cloth 300 container 221*a* or 221*b*. In the drawings and the description, an example in which the post-use mopping cloth container 221*a* or 221*b* is detachably disposed in the mopping cloth receiving space formed in each of the first mopping cloth separator 220*a* and the second mopping cloth separator 220*b* is illustrated and described, but the disclosure is not limited thereto. According to an embodiment, the mopping cloth 300 separated from the robotic vacuum cleaner 100 may be received in the post-use mopping cloth receiving space recessed from the upper surface of the docking station 200 without a separate detachable mopping cloth container.

According to an embodiment, each mopping cloth separator 220*a* or 220*b* may include a head portion 222*a* or 222*b*. According to an embodiment, each head portion 222*a* or 222*b* may extend vertically from the bottom surface (e.g., the portion recessed deepest from the upper surface of the docking unit 212) of each mopping cloth receiving space formed in each mopping cloth separator 220*a* or 220*b*. According to an embodiment, a hole (not shown) through which respective corresponding head portion 222*a* or 222*b* passes may be formed in the central portion of the bottom surface of the first or second post-use mopping cloth container 221*a* or 221*b* received in each mopping cloth receiving space. According to an embodiment, each head portion 222*a* or 222*b* may be at least partially received inside the first or second post-use mopping cloth container 221*a* or 221*b*. According to an embodiment, the head portion 222*a* or 222*b* may be disposed to pass through the hole (not shown) of a respective corresponding mopping cloth container 221*a* or 221*b*. According to an embodiment, at least one end of the head portion 222*a* or 222*b* may be configured to pass through and be inserted into the hole 301 of the mopping cloth 300 coupled to the robotic vacuum cleaner 100. According to an embodiment, after the head portion 222*a* or 222*b* is inserted into the hole 301 of the mopping cloth 300 having one end coupled to the robotic vacuum cleaner 100, a force may be applied to the mopping cloth 300 to separate the mopping cloth 300 from the robotic vacuum cleaner 100. According to an embodiment, after one end of the head portion 222*a* or 222*b* is inserted into the hole 301 of the mopping cloth 300 having one end coupled to the robotic vacuum cleaner 100, a force that resists the force (e.g., force in the vertical direction or rotation direction) applied to the mopping cloth 300 from the robotic vacuum cleaner 100 is applied to the mopping cloth 300 to separate the mopping cloth 300 from the robotic vacuum cleaner 100.

Although not shown in the drawings, in an embodiment, the lower end of the head portion 222 may be connected to an actuator (not shown). In this case, the head portion 222 may ascend or descend according to the operation of an actuator (not shown), but the disclosure is not limited thereto.

According to an embodiment, the second portion 212*b* of the docking unit 212 may include a first mopping cloth coupler 230*a* and a second mopping cloth coupler 230*b* disposed side by side. According to an embodiment, the first mopping cloth coupler 230*a* and the second mopping cloth coupler 230*b* may be positioned upstream of the first mopping cloth separator 220*a* and the second mopping cloth separator 220*b* with respect to the direction (e.g., F direction) in which the robotic vacuum cleaner 100 enters the docking unit.

According to an embodiment, each of the first mopping cloth coupler 230*a* and the second mopping cloth coupler 230*b* may supply the mopping cloth to be mounted on the robotic vacuum cleaner 100 from a lower end of the docking station 200. According to an embodiment, each of the first mopping cloth coupler 230*a* and the second mopping cloth coupler 230*b* may include a pre-use mopping cloth receiving space recessed downward from the upper surface of the second portion 212*b*. According to an embodiment, in each of the first mopping cloth coupler 230*a* and the second mopping cloth coupler 230*b*, each of one or more mopping cloths 300 to be supplied to the robotic vacuum cleaner 100 may be received in a respective corresponding pre-use mopping cloth receiving space. According to an embodiment, the first mopping cloth coupler 230*a* and the second mopping cloth coupler 230*b* each may include a first pre-use mopping cloth container 231*a* or a second pre-use mopping cloth container 231*b* received in a respective corresponding pre-use mopping cloth receiving space. According to an embodiment, each of the first or second pre-use mopping cloth container 231*a* or 231*b* may be shaped as an empty cylinder with a top opening, but the disclosure is not limited thereto.

According to an embodiment, the first or second pre-use mopping cloth container 231*a* and 231*b* each may receive one or more pre-use mopping cloths 300. in an embodiment, a plurality of pre-use mopping cloths 300 may be vertically stacked inside the first or second pre-use mopping cloth container 231*a* or 231*b*.

According to an embodiment, a pair of first mopping cloth ribs 2311*a* or a pair of mopping cloth ribs 2311*b* facing each other may be disposed on the upper surface edge of the second portion 212*b* of the docking unit 212, corresponding to each pre-use mopping cloth storage space. According to an embodiment, a pair of first mopping cloth ribs 2311*a* or a pair of mopping cloth ribs 2311*b* facing each other may be disposed on the upper surface edge of each of the first or second pre-use mopping cloth container 231*a* or 231*b* received in the respective pre-use mopping cloth receiving space. According to an embodiment, each of the mopping cloth rib pairs 2311*a* and 2311*b* may prevent the mopping cloths 300 stacked inside the corresponding pre-use mopping cloth container 231*a* or 231*b* from escaping from the corresponding space. According to an embodiment, each mopping cloth rib pair 2311*a* or 2311*b* may be disposed on two opposite side ends of the upper surface edge of the corresponding pre-use mopping cloth storage space or pre-use mopping cloth container 231*a* or 231*b*. According to an embodiment, each mopping cloth rib pair 2311*a* or 2311*b* may be configured in such a form as to extend upward from the upper surface edge of the corresponding pre-use mopping cloth receiving space or pre-use mopping cloth container 231*a* or 231*b* and then bend in the direction opposite to the upper surface of the corresponding pre-use mopping cloth receiving space or pre-use mopping cloth container 231*a* or 231*b*. According to an embodiment, each mopping cloth rib pair 2311*a* or 2311*b* may be disposed on the uppermost end of the pre-use mopping cloth receiving space or pre-use mopping cloth container 231*a* or 231*b*, restricting the ascending height of the mopping cloth 300 exposed to the outside and hence preventing it from escaping outward.

According to an embodiment, a mopping cloth tray 232 may be received in each of the pre-use mopping cloth containers 231*a* and 231*b*. According to an embodiment, each mopping cloth tray 232 may be overall shaped as a disc. According to an embodiment, one or more pre-use mopping cloths 300 may be vertically stacked over each mopping cloth tray 232 and be received in a respective corresponding mopping cloth container 231*a* or 231*b*.

According to an embodiment, a mopping cloth support 233 may be disposed under each mopping cloth tray 232. According to an embodiment, each mopping cloth support 233 may be configured to elastically support a respective corresponding mopping cloth tray 232 upward. In an embodiment, the mopping cloth support 233 may include an elastic member, e.g., a spring, having a predetermined elastic force. In this case, the elastic member of the mopping cloth support 233 may be extended/contracted by the load of the mopping cloths 300 stacked over each mopping cloth tray 232. In an embodiment, the elastic force of the elastic member of the mopping cloth support 233 may be set so that the uppermost pre-use mopping cloths 300 are positioned side by side on the upper surface of the second portion 212*b* even when all of the pre-use mopping cloths 300 receivable in the corresponding mopping cloth trays 232*a* and 232*b* are stacked, but the disclosure is not limited thereto.

According to an embodiment, the docking station 200 may include one or more guide members to guide the robotic vacuum cleaner 100 to travel along the correct trajectory of the traveling surface and properly reach the correct position for mopping cloth attachment and/or charging.

According to an embodiment, a pair of first guide recesses 242*a* and 242*b* may be disposed on the second portion 212*b* of the docking unit 212 between the mopping cloth separators 220*a* and 220*b* and the mopping cloth couplers 230*a* and 230*b*. According to an embodiment, the first guide recesses 242*a* and 242*b* may be disposed in widthwise edges of the second portion 212*b*, e.g., the outer positions where both the main wheels 131 of the robotic vacuum cleaner 100 pass.

According to an embodiment, the first guide recesses 242*a* and 242*b* may guide the robotic vacuum cleaner 100 to be properly positioned on the mopping cloth separators 220*a* and 220*b*. As the main wheels 131*a* and 131*b* of the robotic vacuum cleaner 100 are seated on the first guide recesses 242*a* and 242*b*, the robotic vacuum cleaner 100 may be fixed on the upper sides of the mopping cloth separators 220*a* and 220*b*.

According to an embodiment, the first guide recesses 242*a* and 242*b* may protrude from the upper surface of the second portion 212*b* to surround at least portions of the main wheels 131 of the robotic vacuum cleaner 100. According to an embodiment, the first guide recesses 242*a* and 242*b* may be recessed from the upper surface of the second portion 212*b* to surround at least portions of the main wheels 131 of the robotic vacuum cleaner 100.

According to an embodiment, a pair of second guide recesses 243*a* and 243*b* may be disposed in a portion where the first portion 212*a* and the second portion 212*b* are connected of the docking unit 212. According to an embodiment, the second guide recesses 243*a* and 243*b* may be disposed in widthwise edges of the second portion 212*b*, e.g., the outer positions where both the main wheels 131 of the robotic vacuum cleaner 100 pass.

According to an embodiment, the second guide recesses 243*a* and 243*b* may guide the robotic vacuum cleaner 100 to be properly positioned on the mopping cloth couplers 230*a* and 230*b*. As the main wheels 131*a* and 131*b* of the robotic vacuum cleaner 100 are seated on the second guide recesses 243*a* and 243*b*, the robotic vacuum cleaner 100 may be fixed on the upper sides of the mopping cloth couplers 230*a* and 230*b*.

According to an embodiment, the docking station 212 may include an anti-collision portion 244, as one of guide members to guide the robotic vacuum cleaner 100 to travel along the correct trajectory of the traveling surface and properly reach the correct position for mopping cloth separation and/or charging. In an embodiment, the anti-collision portion 244 may be disposed on the path where the robotic vacuum cleaner 100 entering the docking station 200 passes before reaching the correct positions of the mopping cloth couplers 230*a* and 230*b* although reaching near the mopping cloth couplers 230*a* and 230*b* on both sides, on the upper surface of the second portion 212*b*. In an embodiment, the anti-collision portion 244 may be formed to be inclined along the traveling direction of the robotic vacuum cleaner 100 traveling toward the mopping cloth couplers 230*a* and 230*b*. In an embodiment, the height of the anti-collision portion 244 from the upper surface of the second portion 212*b* may be set to be equal to the height of the mopping cloth ribs 2311*a* and 2311*b*. According to an embodiment, the anti-collision portion 244 may prevent the first sub wheel 132 from colliding with the mopping cloth rib 2311*a* or 2311*b* when the robotic vacuum cleaner 100 enters up the mopping cloth couplers 230*a* and 230*b*. The robotic vacuum cleaner 100, traveling on the upper surface of the second portion 212*b*, may avoid collision with the mopping cloth ribs 2311*a* and 2311*b* through the anti-collision portion 244 while reaching a wheel stopper 241 through the mopping cloth ribs 2311*a* and 2311*b*, and may thus be seated in the correct position of the mopping cloth separators 220.

According to an embodiment, the wheel stopper 241 may be disposed on the second portion 212*b* in the opposite position far away from the first portion 212*a*. In an embodiment, the wheel stopper 241 may be disposed between the main body unit 211 and the mopping cloth separators 220*a* and 220*b*. In an embodiment, the wheel stopper 241 may be configured to surround at least a portion of the first sub wheel 132 of the robotic vacuum cleaner 100. According to an embodiment, the wheel stopper 241 may guide the robotic vacuum cleaner 100 to be properly positioned on each mopping cloth separator 220*a* and 220*b*. For example, if the first sub wheel 132 of the robotic vacuum cleaner 100 touches the wheel stopper 241 while the robotic vacuum cleaner 100 travels on the second portion 212*b*, the robotic vacuum cleaner 100 may be stopped from further moving and be properly positioned on the mopping cloth separators 220*a* and 220*b*.

According to an embodiment, the main body unit 211 may be coupled to the docking unit 212. According to an embodiment, the main body unit 211 may be disposed on one side of the second portion 212*b* of the docking unit 212. According to an embodiment, the main body unit 211 may be positioned on one side far away from the first portion 212*a*, on the second portion 212*b*. According to an embodiment, charging terminals 2111 configured to contact the charging terminals 1111*a* and 1111*b* of the robotic vacuum cleaner 100 may be provided on the lower portion of the main body unit 211. In an embodiment, the charging terminals 2111 may be disposed on one surface (e.g., R direction) of the main body unit 211 facing the robotic vacuum cleaner 100 in a state in which the robotic vacuum cleaner 100 is seated in the correct position on the second portion 212*b* for charging.

Figure 7:
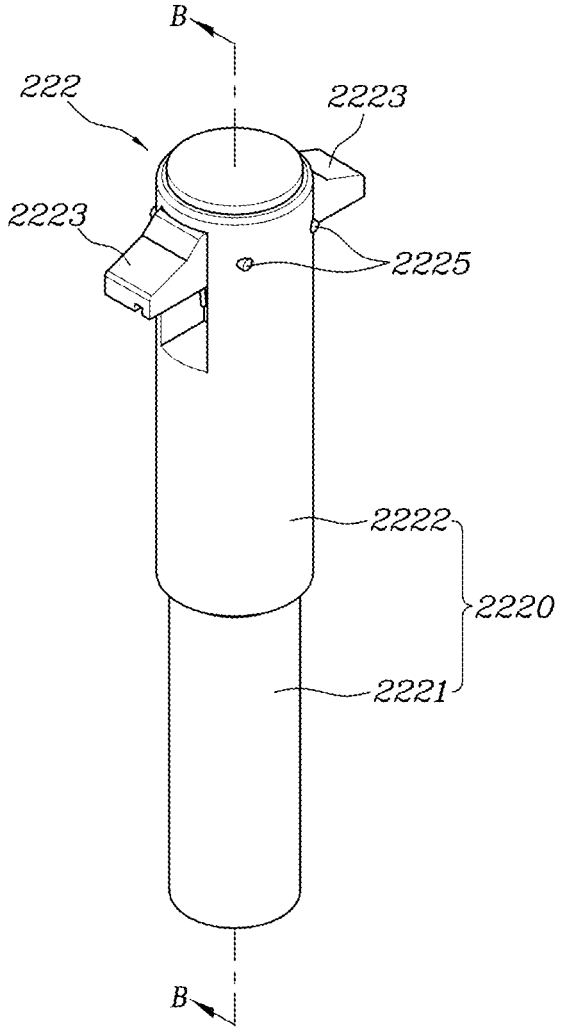
FIG. 7 is a perspective view illustrating a head portion of a mopping cloth separator according to an embodiment of the disclosure.
Figure 8:
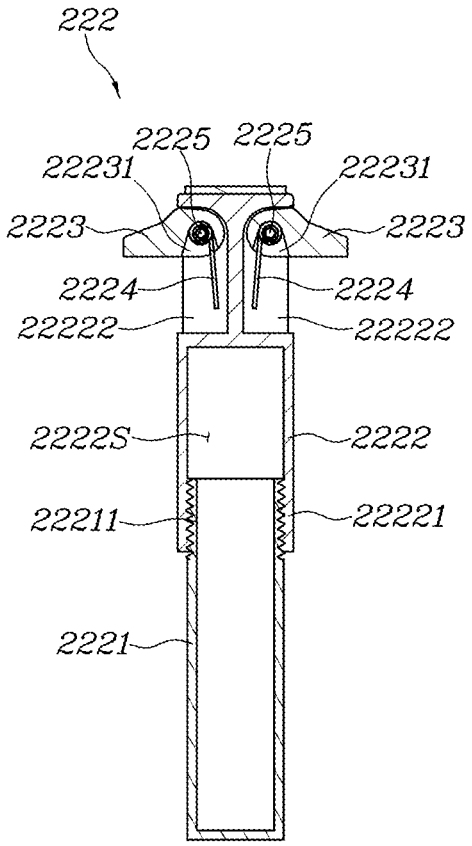
FIG. 8 is a cross-sectional view of a head portion taken along line B-B of FIG. 7 according to an embodiment of the disclosure.

FIG. 7 is a perspective view illustrating a head portion of a mopping cloth separator according to an embodiment. FIG. 8 is a cross-sectional view of a head portion taken along line B-B of FIG. 7 according to an embodiment.

Referring to FIGS. 7 and 8, in an embodiment, a head portion 222 may include a body portion 2220 forming the overall exterior of the head portion 222 and a pair of hooks 2223 rotatably connected to the body portion 2220.

According to an embodiment, the body portion 2220 may include a first body 2221 and a second body 2222 coupled to an upper side of the first body 2221. According to an embodiment, the first body 2221 may form the lower exterior of the head portion 222. According to an embodiment, the first body 2221 may have a cylindrical shape as a whole, but is not limited thereto. According to an embodiment, a thread 22211 (e.g., a male thread) may protrude from the outer circumferential surface of the upper end of the first body 2222.

According to an embodiment, the second body 2222 may form the upper exterior of the head portion 222. According to an embodiment, the second body 2222 may have a cylindrical shape as a whole, but is not limited thereto. According to an embodiment, the second body 2222 may be detachably coupled to the first body 2221. According to an embodiment, a fastening portion 2222*s* which is open downward to have at least a portion of the first body 2221 inserted therethrough may be formed in the bottom surface of the second body 2222. According to an embodiment, a thread 22221 (e.g., a female thread) that engages with the thread 22211 of the first body 2221 may be formed on the inner circumferential surface of the end of the fastening portion 2222*s*. In this case, if the second body 2222 is rotated in the first rotation direction (e.g., clockwise) with respect to the first body 2221 by an external force, the second body 2222 may be moved downward along the thread 22211 of the first body 2221 so that the second body 2222 may be fastened to the first body 2221. Conversely, if the second body 2222 is rotated in the second rotation direction (e.g., counterclockwise) with respect to the first body 2221 by an external force, the second body 2222 may be moved upward along the thread 22211 of the first body 2221 so that the second body 2222 may be separated from the first body 2221.

According to an embodiment, a pair of receiving recesses 22222 recessed from two opposite sides to the inside by a predetermined depth may be disposed in the upper portion of the second body 2222. According to an embodiment, the receiving recesses 22222 may be disposed to face each other with respect to the center line (not shown) of the head portion 222.

According to an embodiment, the head portion 222 may include a pair of hooks 2223 rotatably connected to the second body 2222. According to an embodiment, each of the pair of hooks 2223 may have an inclined upper surface and a flat lower surface, but is not limited thereto. According to an embodiment, each of the pair of hooks 2223 may be coupled to the second body 2222 through a respective fastening shaft 2225 penetrating the second body 2222. According to an embodiment, each of the pair of hooks 2223 may have a free end on the opposite side of the portion (i.e., the coupling portion) coupled to the second body 2222. According to an embodiment, each of the pair of hooks 2223 may be disposed in a respective one of the pair of receiving recesses 22222. In this case, although not shown in the drawings, the pair of hooks 2223 may be rotated to a folded state so that the respective free ends approach each other toward the inside (e.g., toward the receiving recesses 22222) of the head portion 222. In such a folded state, the pair of hooks 2223 may be received in the pair of receiving recesses 22222, respectively. If the free ends are rotated outward to face far away from each other and the head portion 222, the pair of hooks 2223 may be unfolded to the outside (deployed state) as shown in FIGS. 7 and 8.

According to an embodiment, a pair of hook elastic members 2224 may be configured to transfer a predetermined elastic force (or restoring force) to the hooks 2223 to allow the pair of hooks 2223 to remain in the deployed state (e.g., a state in which the free ends faces outward and away from each other). According to an embodiment, the pair of hooks 2223 may remain in the deployed state while no external force is applied by each hook elastic member 2224. According to an embodiment, each hook elastic member 2224 may include a spring including a predetermined elastic force (or restoring force). According to an embodiment, each of the pair of hooks 2223 may include a receiving recess 22231 to receive at least a portion of a respective corresponding hook elastic member 2224. According to an embodiment, each hook elastic member 2224 may be disposed in the receiving recess 22231 while surrounding the fastening shaft 2225. According to an embodiment, the free end of each hook 2223 may be maintained outside away from the receiving recess 2224, and the pair of hooks 2223 may remain in the deployed state by the elastic force of the hook elastic member 2224.

Figure 9:
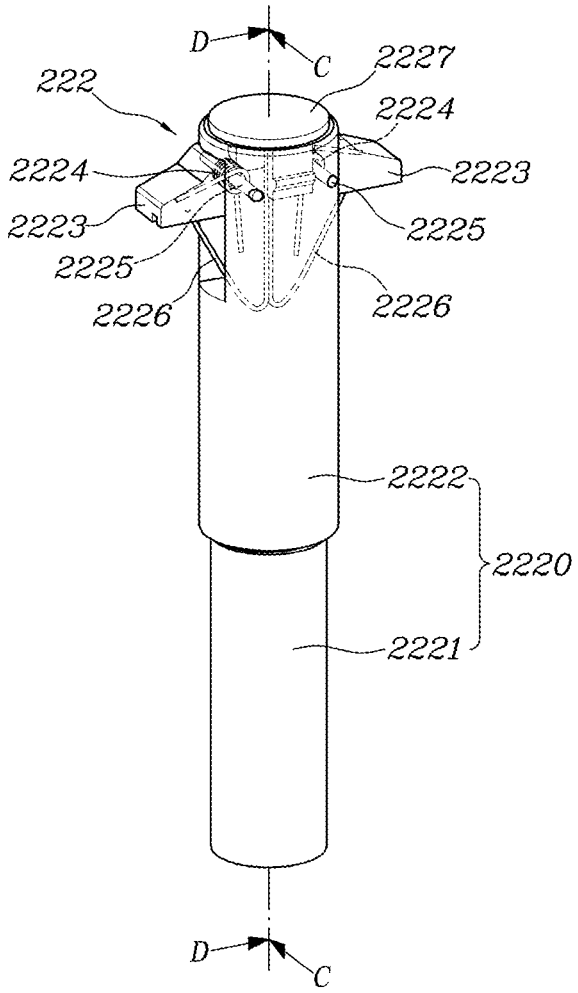
FIG. 9 is a perspective view illustrating a head portion according to an embodiment of the disclosure.
Figure 10A:
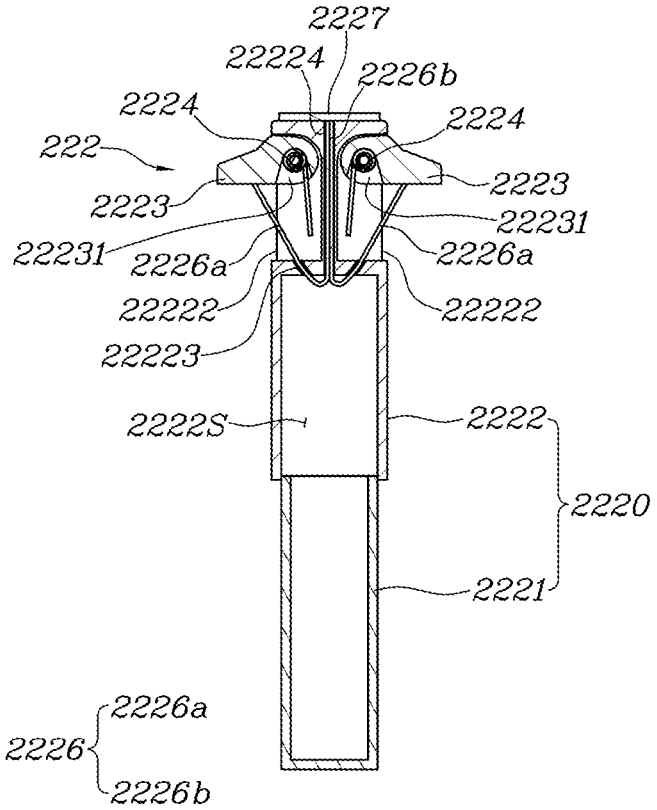
FIG. 10A is a cross-sectional view of a head portion taken along line C-C of FIG. 9 according to an embodiment of the disclosure.
Figure 10B:
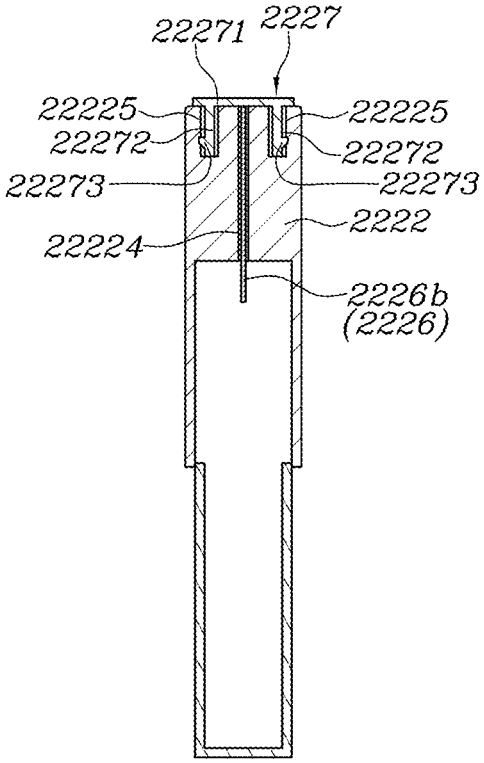
FIG. 10B is a cross-sectional view of a head portion taken along line D-D of FIG. 9 according to an embodiment of the disclosure.
Figure 11A:
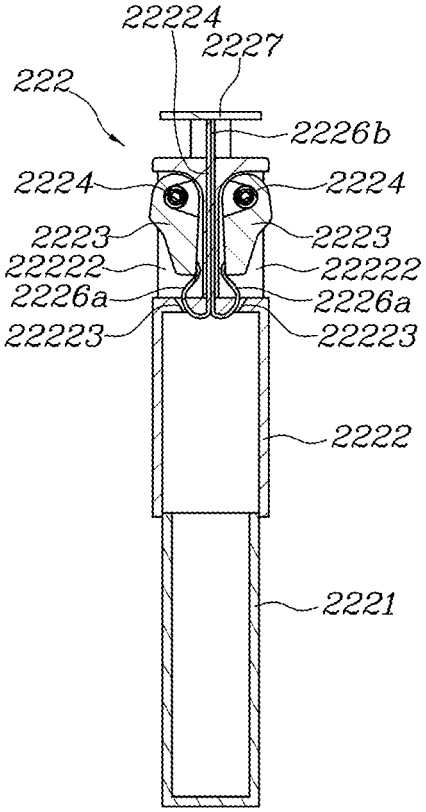
FIG. 11A is a cross-sectional view illustrating a received state of a head portion according to an embodiment of the disclosure.
Figure 11B:
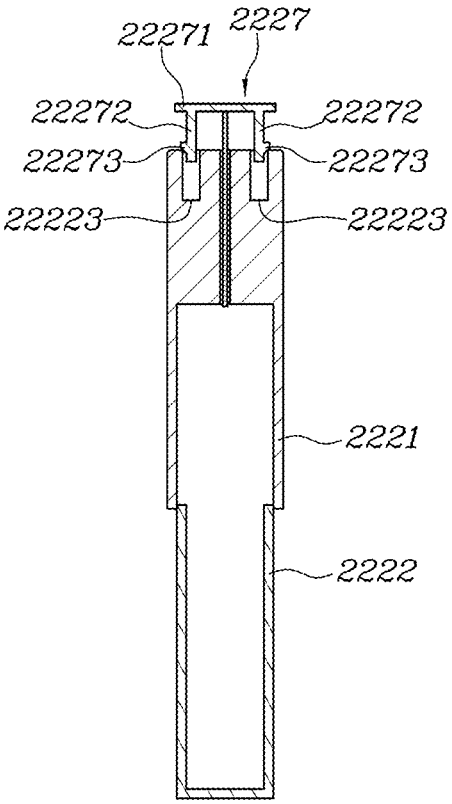
FIG. 11B is a cross-sectional view illustrating a received state of a head portion, as viewed in a different direction, according to an embodiment of the disclosure.

FIG. 9 is a perspective view illustrating a head portion according to an embodiment. FIG. 10A is a cross-sectional view of a head portion taken along line C-C of FIG. 9 according to an embodiment. FIG. 10B is a cross-sectional view of a head portion taken along line D-D of FIG. 9 according to an embodiment. FIG. 11A is a cross-sectional view illustrating a received state of a head portion according to an embodiment. FIG. 11B is a cross-sectional view illustrating a received state of a head portion, as viewed in a different direction, according to an embodiment.

Referring to FIGS. 9 to 11, in an embodiment, the head portion 222 may include a structure capable of adjusting an active state or an inactive state of the above-described pair of hooks 2223. In an embodiment, the active state denotes a state in which the pair of hooks 2223 may be rotated to switch between the folded state and the deployed state depending on whether an external force is applied. In an embodiment, the inactive state denotes a state in which the pair of hooks 2223 remain in the current state without returning to the deployed state although no further external force is applied in the folded state. According to an embodiment, a pair of wires 2226 and a button portion 2227 may be included as such a structure.

According to an embodiment, the button portion 2227 may be disposed on the upper surface of the head portion 222. According to an embodiment, the respective ends 2226*a* of the pair of wires 2226 may be connected to the pair of hooks 2223. In an embodiment, the respective ends 2226*a* of the wires 2226 may be connected close to the free ends of the corresponding hooks 2223. According to an embodiment, the other ends of the pair of wires 2226 may be connected to the button portion 2227. According to an embodiment, the pair of wires 2226 may be changed in shape as the pair of hooks 2223 are rotated. The pair of wires 226 may maintain their overall length while changing in shape. According to an embodiment, the pair of wires 2226 may be formed of a flexible material to be easily bent or warped. The pair of wires 2226 may be, e.g., iron wires, copper wires, or aluminum wires.

According to an embodiment, the second body 2222 may include a pair of first wire holes 22223 and second wire holes 22224 for receiving at least portions of the wires 2226. According to an embodiment, each first wire hole 22223 may be formed to obliquely penetrate the bottom surface of the corresponding receiving recess 22222. According to an embodiment, each first wire hole 22223 may communicate with the corresponding receiving recess 22222 and fastening portion 2222*s*. According to an embodiment, each first wire hole 22223 may have at least a portion of one end of the corresponding wire 2226 received therein. According to an embodiment, the second wire hole 22224 may be formed to penetrate the center of the second body 2222. According to an embodiment, the second wire hole 22224 may communicate with the fastening portion 2222*s*. According to an embodiment, at least a portion of the other end 2226*b* of each of the pair of wires 2226 may be received in the second wire hole 22224.

According to an embodiment, the button portion 2227 disposed on the upper surface of the head portion 222 may include a flat plate portion 22271 and a pair of stop jaws 22272. According to an embodiment, the flat plate portion 22271 may form the overall exterior of the button portion 2227. According to an embodiment, the flat plate portion 22271 may be shaped as a disc, but is not limited thereto. According to an embodiment, the pair of wires 2226 may be connected to the lower surface of the flat plate portion 22271.

According to an embodiment, the pair of stop jaws 22272 may extend downward from the lower surface of the flat plate portion 22271. According to an embodiment, each of the pair of stop jaws 22272 may include a stopping portion 22273 disposed on one lower end. According to an embodiment, the stopping portion 22273 may vertically protrude and have an inclined surface.

According to an embodiment, the second body 2222 may include a pair of stopping recesses 22225 formed in the upper surface of the second body 2222. According to an embodiment, the pair of stopping recesses 22225 may be recessed downward from the upper surface of the second body 2222. According to an embodiment, each of the pair of stopping recesses 22225 may receive a respective stop jaw 22272.

According to an embodiment, the button portion 2227 may be manipulated to adjust the pair of hooks 2223 to the active state or inactive state as described above. According to an embodiment, the button portion 2227 may be moved upward to a predetermined height from the upper surface of the second body 2222 by an external force (e.g., force pulling upward). According to an embodiment, when the button portion 2227 is moved upward from the upper surface of the second body 2222, the hooks 2223 may be rotated to the folded state through the pair of wires 2226. According to an embodiment, the button portion 2227 may be brought in tight contact with the upper surface of the second body 2222 by an external force (e.g., force pressing down).

FIGS. 10A and 10B are views illustrating a state in which the respective free ends of the pair of hooks 2223 are stretched out from the receiving recesses 2222.

Referring to FIGS. 10A and 10B, as an external force (e.g., force pressing down the button portion 2227) acts on the button portion 2227 downward, the button portion 2227 comes in tight contact with the upper surface of the second body 2222. Although not specifically illustrated, according to an embodiment, the stopping portion 22273 of each of the pair of stop jaws 22272 may contact the stopping recess 22225 formed in the upper surface of the second body 2222. According to an embodiment, as the stop jaw 22272 is bent through the inclined surface formed on the stopping portion 22273 and slidingly inserted into the stopping recess 22225 by an external force while the button portion 2227 is placed on the upper surface of the first block, at least a portion of the stop jaw 22272 may be received inside the upper surface of the second body 2222. In an embodiment, the other end 2226*b* of the wire 2226 connected to the lower surface of the button portion 2227, along with the button portion 2227, may be disposed close to the upper surface of the second body 2222 and be received in the second wire hole 22224. According to an embodiment, the one end 2226*a* of the wire 2226 may pass through the first wire hole 22223 and be then exposed to the outside through the receiving recess 22222. In such a case, the free end of each hook 2223 may be in the state deployed outward by the elastic force by the hook elastic member 2224 without disturbance from the wire 2226.

FIGS. 11A and 11B are views illustrating a state in which the free end of each of the pair of hooks 2223 is received in the receiving recess 22222.

Referring to FIGS. 11A and 11B, as an external force (e.g., force pulling the button portion 2227) acts on the button portion 2227 upward, the button portion 2227 is spaced apart from the upper surface of the second body 2222 and moved to an upper position. In an embodiment, the other end 2226*b* of the wire 2226 connected to the lower surface of the button portion 2227 may be disposed away from the second wire hole 22224 on the upper surface of the second body 2222 to be at least partially exposed to the outside. Further, one end 2226*a* of the wire 2226 is bent to the inside of the receiving recess 22222 to reduce the portion exposed from the receiving recess 22222 and, during the course, each of the pair of hooks 2223 connected to the one end 2226*a* of the wire 2226 may be rotated to the inside of the receiving recess 22222 to be received in the receiving recess 22222. Although not specifically shown, according to an embodiment, as moved upward by external force, the pair of stop jaws 22272 are released from the stopping recesses 22225, and the stopping portion 22273, which was bent by contact by the stopping recess 22225 may be stretched outward to recover to the circular shape. At this time, the inclined surface of the stopping portion 22273 contacts the upper surface of the second body 2222, so that the button portion 2227 is moved downward again by the restoring force of the spring 2224 connected to the pair of hooks 2223, preventing the stop jaw 22272 from being received in the receiving recess 22222. In other words, as the restoring force of the spring 2224 is canceled out by the stopping structure of the stopping portion 22273, the head portion 222 may remain in the state of receiving the pair of hooks 2223.

Figure 12A:
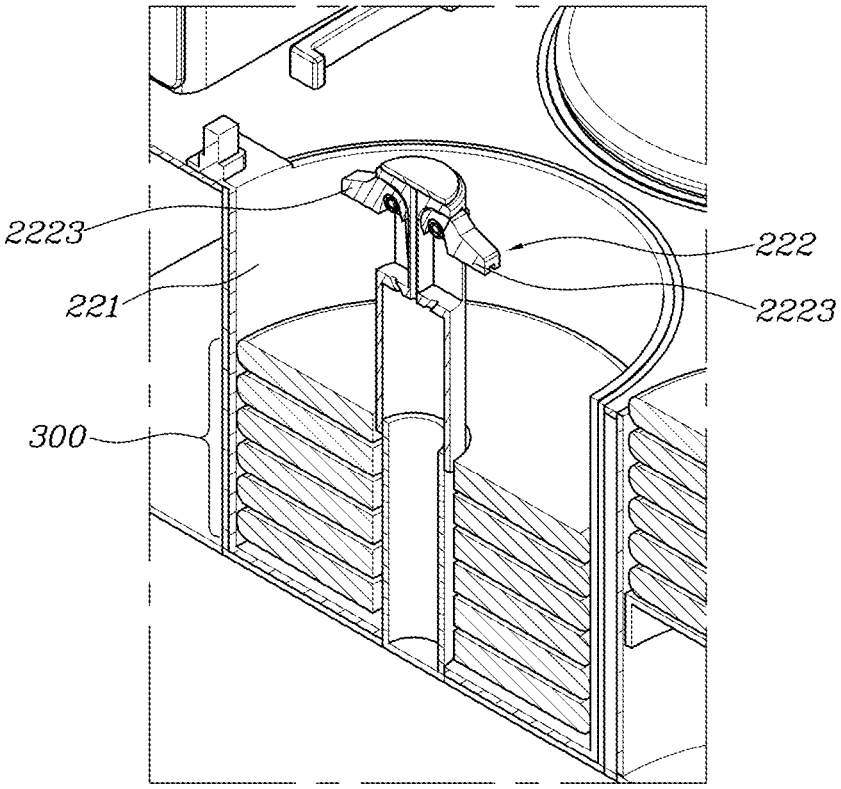
FIGS. 12A, 12B, and 12C are views illustrating a process of detaching a mopping cloth attached to a robotic vacuum cleaner in a mopping cloth separator according to an embodiment of the disclosure.
Figure 12B:
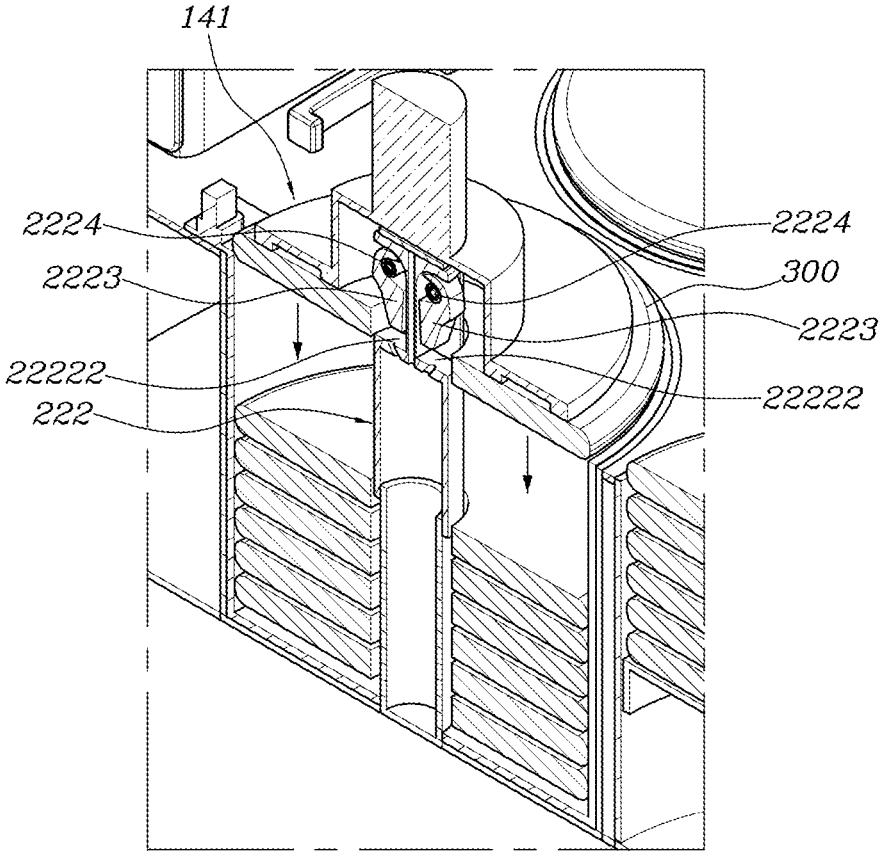
Figure 12C:
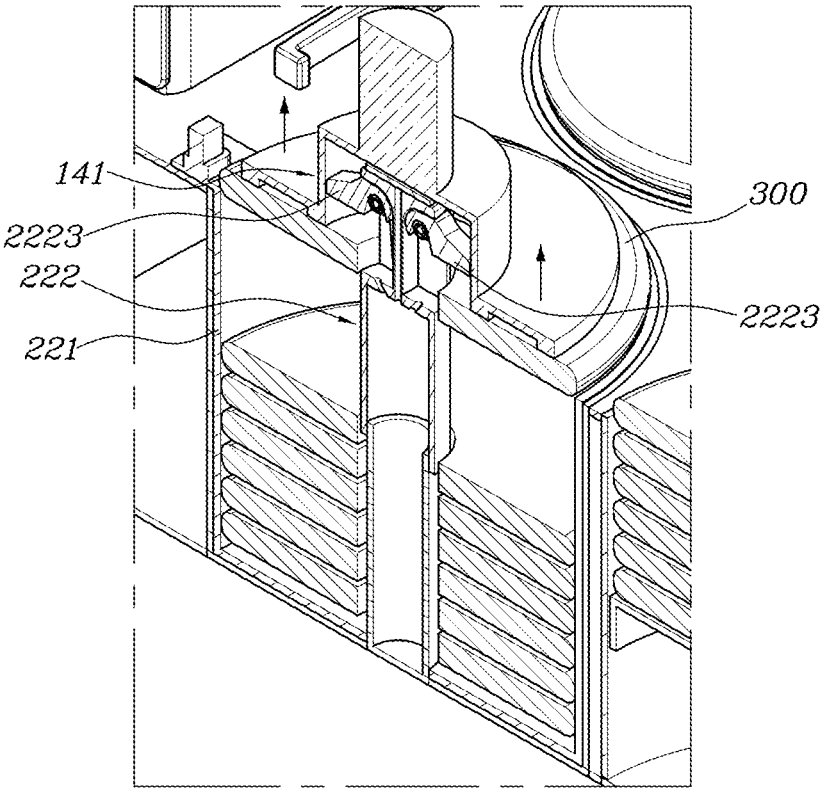

FIGS. 12A, 12B, and 12C are views illustrating a process of detaching a mopping cloth attached to a robotic vacuum cleaner in a mopping cloth separator according to an embodiment.

Referring to FIG. 12A, the pair of hooks 2223 of the head portion 222 remain in the state deployed outward. Meanwhile, although not specifically shown in FIG. 12B, upon detecting arrival at the correct position on the mopping cloth separators 220, the robotic vacuum cleaner 100 may control the driving unit 180 to move down the mopping cloth unit 140 with the post-use mopping cloth attached, by a predetermined distance. In an embodiment, the robotic vacuum cleaner 100 may move the mopping cloth unit 140 vertically downward toward the bottom surface of the mopping cloth separator 220 positioned thereunder and/or the head portion 222 installed thereon.

When the mopping cloth unit 140 descends toward the head portion 222, the lower surface of the mopping cloth 300 attached to the mopping cloth unit 140 (the surface opposite to the surface to which the mopping cloth unit 140 is attached) may contact the pair of hooks 2223 of the head portion 222 remaining in the deployed state, particularly, the free end of each hook 2223. According to an embodiment, an external force (e.g., force pressing down the mopping cloth unit 140) from the robotic vacuum cleaner 100 to move down the mopping cloth unit 140 may be applied to the free end of each hook 2223. According to an embodiment, as external force is applied vertically downward, the respective free ends of the pair of hooks 2223 may be rotated to the folded state to approach each other. According to an embodiment, the respective free ends of the pair of hooks 2223 in the folded state may be received in the receiving recesses 22222.

In the folded state of the pair of hooks 2223, at least a portion of the head portion 222 including the pair of hooks 2223 in the folded state may pass through the hole 301 of the mopping cloth 300 attached to the mopping cloth unit 140. According to an embodiment, after the pair of hooks 2223 pass through the hole of the mopping cloth 300, the robotic vacuum cleaner 100 may control the driving unit 180 to stop the mopping cloth unit 140 from descending. According to an embodiment, after the pair of hooks 2223 pass through the hole of the mopping cloth 300, contact between the lower surface of the mopping cloth 300 and each free end may be released, and the external force applied to each free end vertically downward may disappear. According to an embodiment, when the external force applied vertically downward disappears, the respective free ends of the pair of hooks 2223 may be restored to the state before rotation by the external force, by the restoring force of the hook elastic member 2224. According to an embodiment, when the external force disappears, the respective free ends of the pair of hooks 2223 may rotate far away from each other outward of the receiving recess 22222 and become the deployed state.

According to an embodiment, the robotic vacuum cleaner 100 may again control the driving unit to move up the mopping cloth unit 140. At this time, the respective free ends of the pair of hooks 2223 in the deployed state are in contact with the upper surface of the mopping cloth 300 attached to the mopping cloth unit 140. According to an embodiment, when the robotic vacuum cleaner 100 moves upward the mopping cloth unit 140, the pair of hooks 2223 may apply a force (e.g., reaction force against the ascent of the mopping cloth unit 140) against the external force of the robotic vacuum cleaner 100 acting to the mopping cloth 300 to the mopping cloth 300 attached to the mopping cloth unit 140. Accordingly, the mopping cloth 300 may be separated from the robotic vacuum cleaner 100 by the force given to the mopping cloth 300 from the pair of hooks 2223. In an embodiment, at least a portion of the head portion 222 including the pair of hooks 2223 may remain in the state of having passed through the hole 301 of the mopping cloth 300. The mopping cloth 300 separated from the mopping cloth unit 140 may fall downward along the head portion 222 and be vertically stacked in the post-use mopping cloth container 221*a* or 221*b* or post-use mopping cloth receiving space.

In the above description in connection with FIGS. 12A to 12C, the mopping cloth 300 attached to the robotic vacuum cleaner 100 is separated by the ascent/descent of the mopping cloth unit 140 by the robotic vacuum cleaner 100. However, the disclosure is not limited thereto. According to an embodiment, when an actuator (not shown) to move up/down the head portion 222 is provided in the docking station 200, the pair of hooks 2223 of the head portion 222 may be folded or unfolded as the head portion 222 ascends/descends, separating the mopping cloth 300 attached to the robotic vacuum cleaner 100.

Figure 13A:
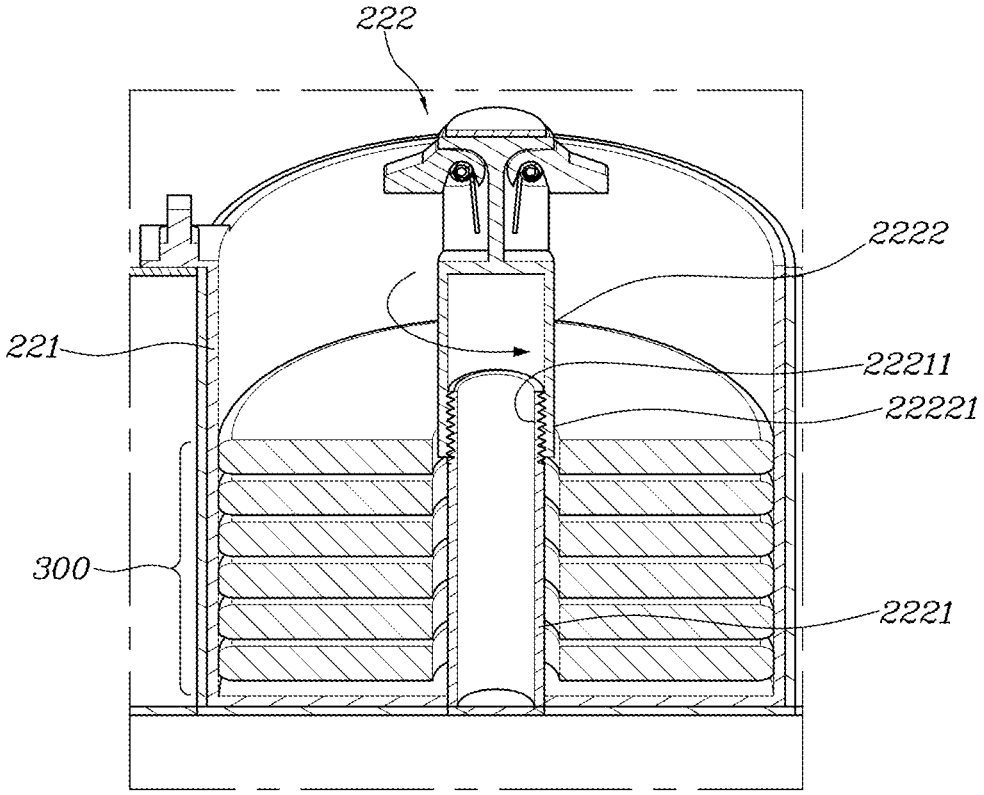
FIGS. 13A, 13B, and 13C are views illustrating a process of collecting a used mopping cloth received, in a mopping cloth separator according to an embodiment of the disclosure.
Figure 13B:
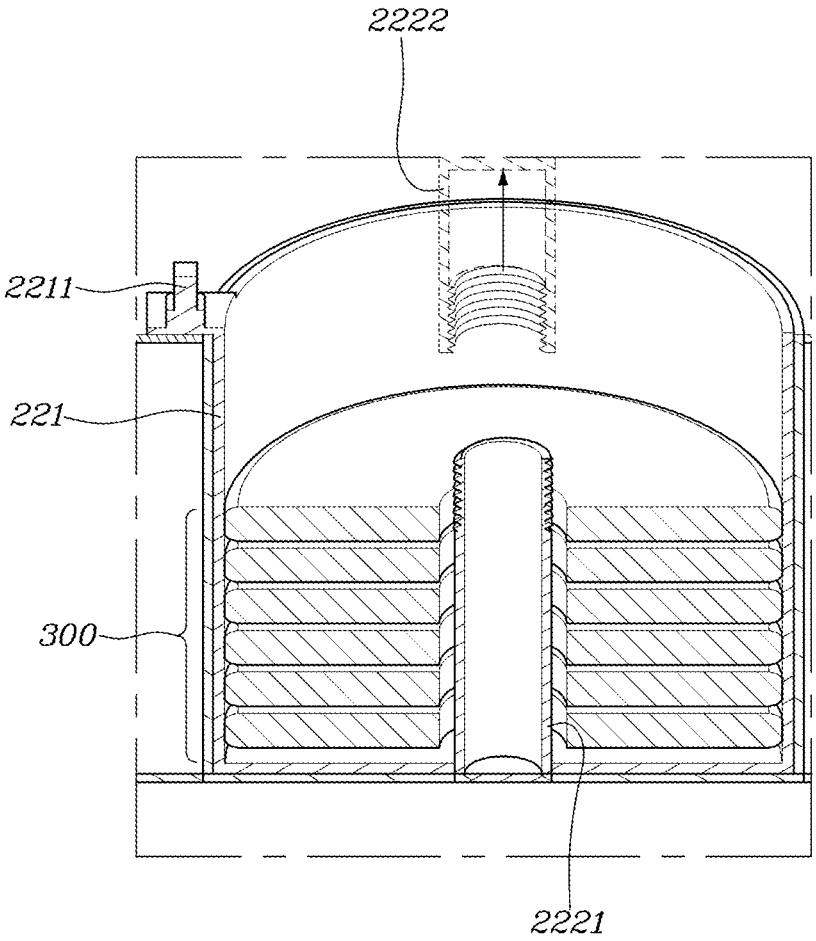
Figure 13C:
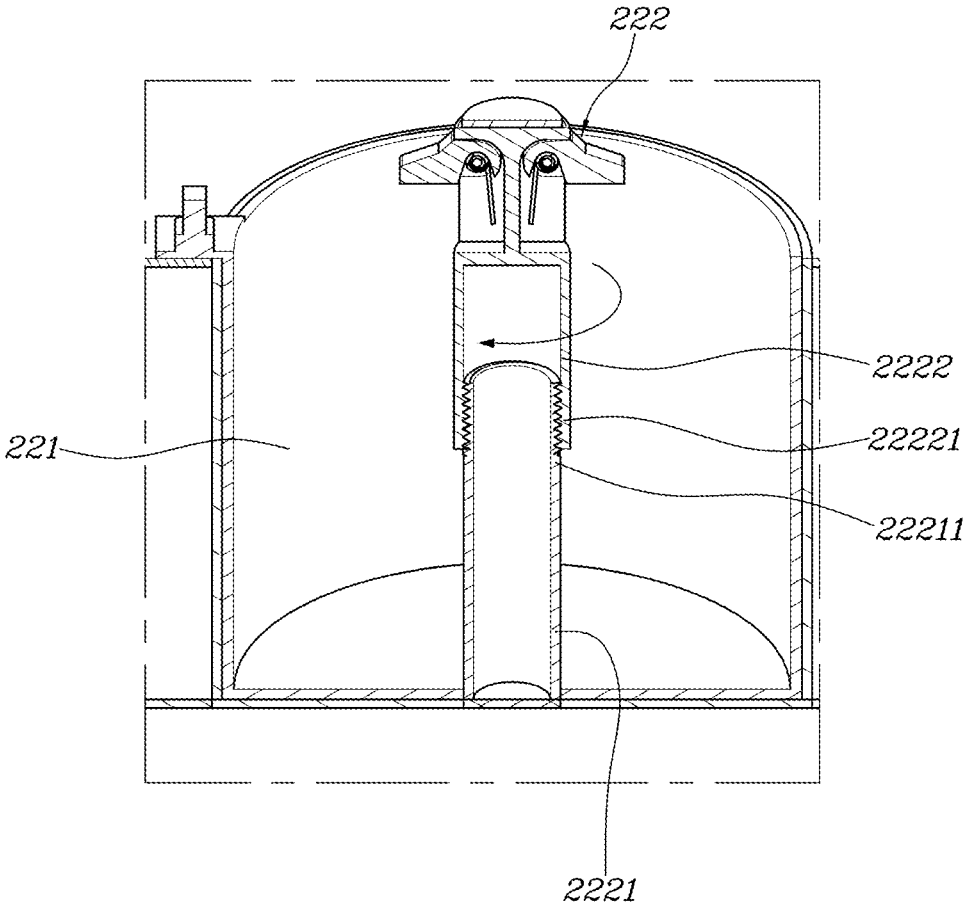

FIGS. 13A, 13B, and 13C are views illustrating a process of collecting a used mopping cloth received, in a mopping cloth separator according to an embodiment.

Referring to FIG. 13A, as described above in connection with FIG. 12, the mopping cloth 300 separated from the robotic vacuum cleaner 100 by the interaction between the head portion 222 and the robotic vacuum cleaner 100 may be vertically stacked in the post-use mopping cloth container 221. Thereafter, to collect the mopping cloths 300 received in the post-use mopping cloth container 221, the user may separate the second body 2222 of the head portion 222 from the first body 2221 and then separate the post-use mopping cloth container 221 from the mopping cloth separator 220.

For example, as shown in FIG. 13, if the user rotates the second body 2222 in the second rotation direction (e.g., counterclockwise) to separate the second body 2222 from the first body 2221, the engagement between the thread 22221 of the second body 2222 and the thread 22211 of the first body 2221 is released, so that the second body 2222 may be rotated up along the threads 22211 and 22221 and separated from the first body 2221 as shown in FIG. 13B. Thereafter, although not specifically in the drawings, if the user holds up the container handle 2211 of the post-use mopping cloth container 221, it may be separated from the robotic vacuum cleaner 100, allowing the user to easily collect the mopping cloths 300 received in the post-use mopping cloth container 221.

If collection of the mopping cloths 300 separated from the robotic vacuum cleaner 100 is done, the user may couple the empty post-use mopping cloth container 221 back to the mopping cloth separator 220 and, as shown in FIG. 13C, engage the thread 22221 of the second body 2222 to the thread 22211 of the first body 2221 and then turn the second body 2222 in the first rotation direction (e.g., clockwise) to fasten the first body 2221 and the second body 2222.

Figure 14A:
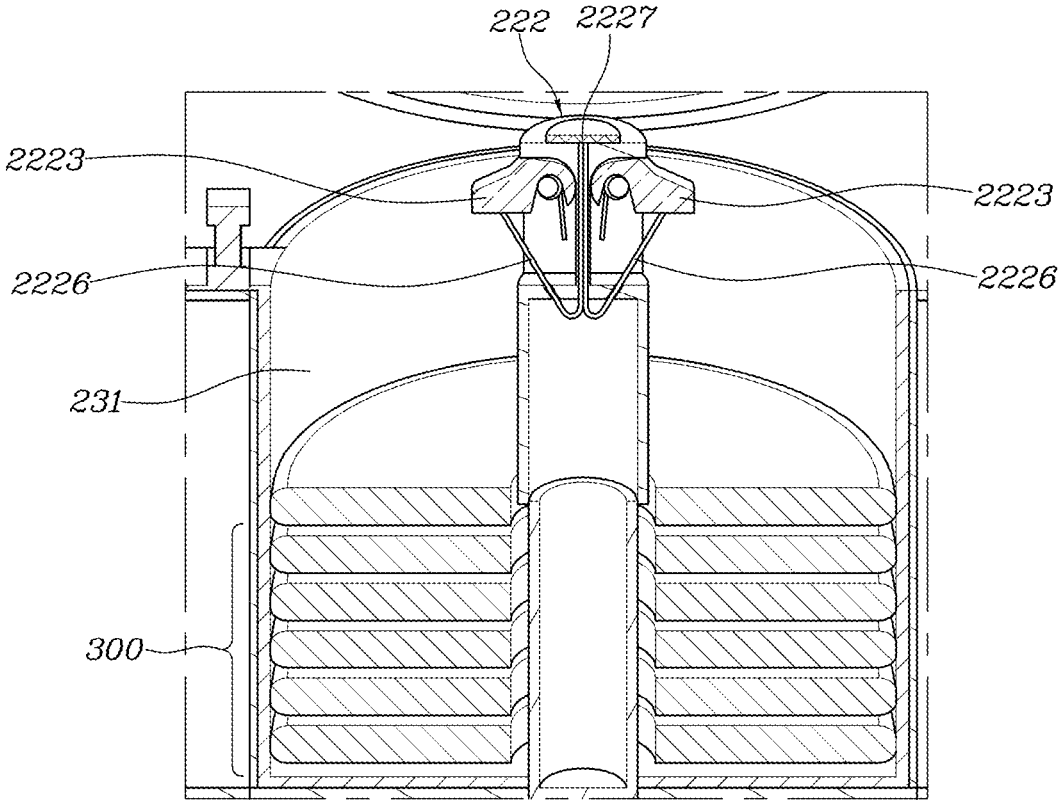
FIGS. 14A, 14B, and 14C are views illustrating a process of collecting a used mopping cloth received, in a mopping cloth separator according to an embodiment of the disclosure.
Figure 14B:
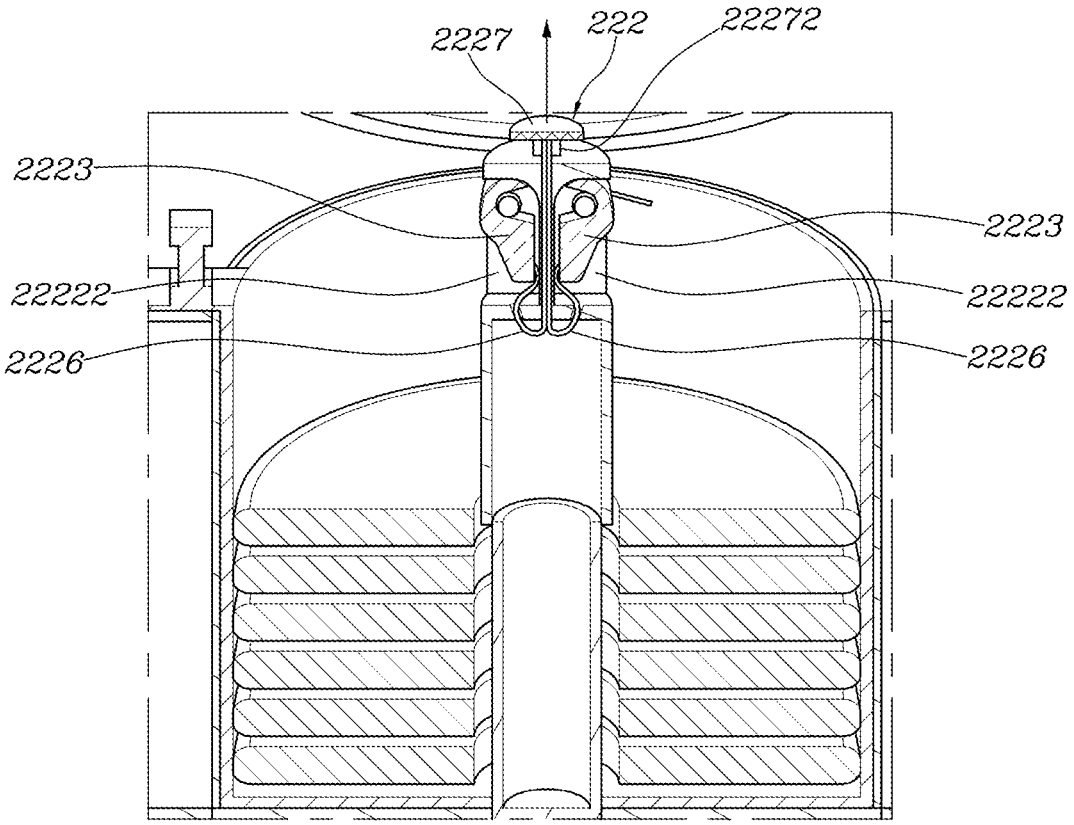
Figure 14C:
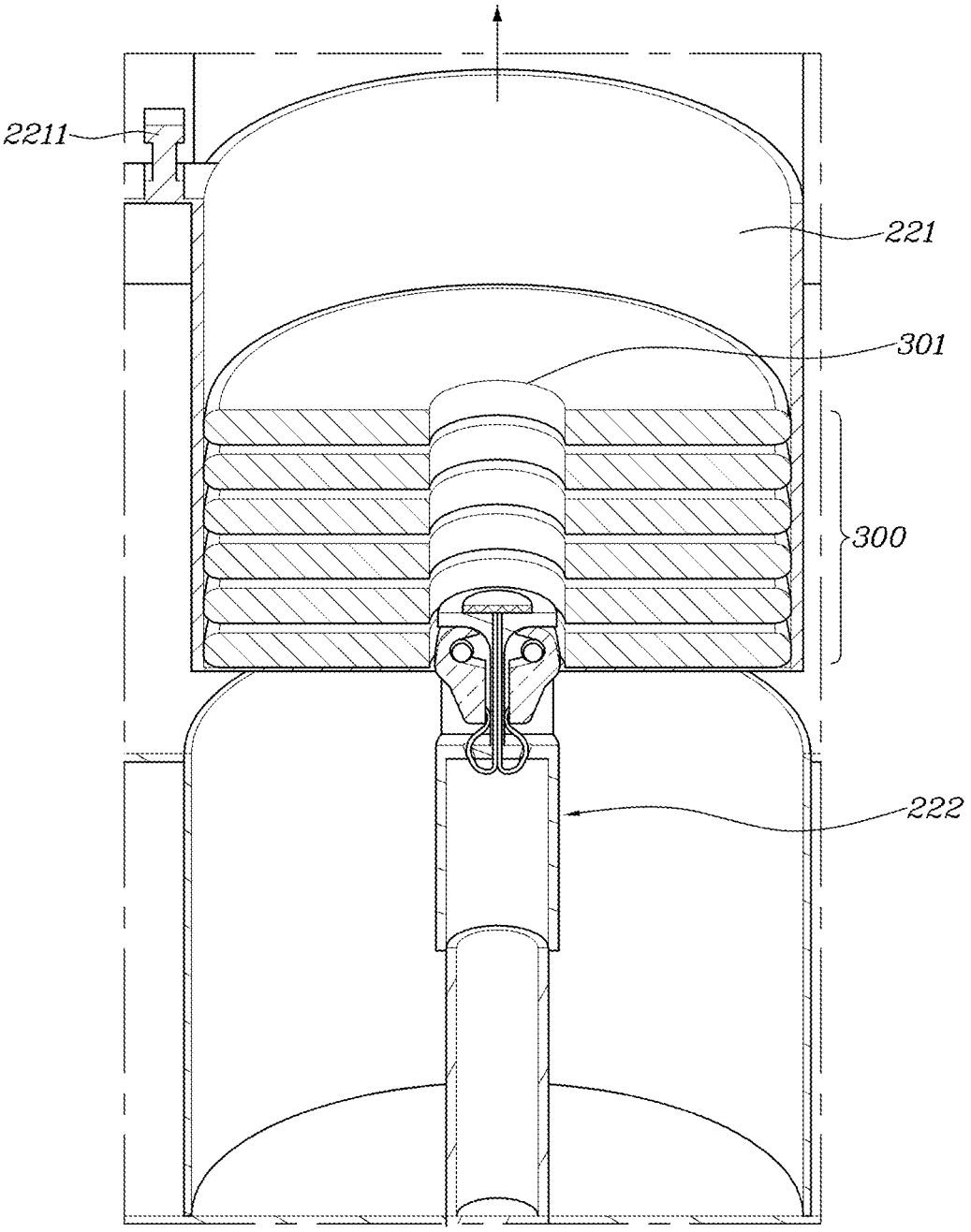

FIGS. 14A, 14B, and 14C are views illustrating a process of collecting a used mopping cloth received, in a mopping cloth separator according to an embodiment.

Referring to FIG. 14A, as described above in connection with FIG. 12, the mopping cloth 300 separated from the robotic vacuum cleaner 100 by the interaction between the head portion 222 and the robotic vacuum cleaner 100 may be vertically stacked in the post-use mopping cloth container 221. Thereafter, to collect the mopping cloths 300 received in the post-use mopping cloth container 221, the user may manipulate the button portion 2227 to switch the deployed state of the pair of hooks 2223 of the head portion 222 to the received state or maintain the state. As shown in FIGS. 14A to 14C, the head portion 222 may include a button portion capable of adjusting the active state and the inactive state of the pair of hooks 2223.

Referring to FIG. 14B, if the user pulls up the button portion 2227, the pair of wires 2226 respectively connected to the pair of hooks 2223 may be deformed, and the pair of hooks 2223 may be rotated and received inside the respective corresponding receiving recesses 22222. As described above in connection with FIG. 11B, the stop jaw 22272 of the button portion 2227 may escape off the stopping recess 22225 of the second body 2222 by the user pulling the button portion 2227, and the stopping portion 22273 of the stop jaw 22272 may contact (or be stuck to) the upper surface of the second body 2222, maintaining the received state of the pair of hooks 2223.

Thereafter, as shown in FIG. 14C, the user may collect the mopping cloths 300 received in the post-use mopping cloth container 221 by lifting the post-use mopping cloth container 221 while gripping the container handle 2211 of the post-use mopping cloth container 221. Thereafter, if collection of the mopping cloth 300 separated from the robotic vacuum cleaner 100 is done, the user may couple the post-use mopping cloth container 221 back to the mopping cloth separator 220 and then press down the button portion 2227 to allow the pair of hooks 2223 to be deployed outward of the receiving recess 22222 as shown in FIGS. 10A and 10B. For example, if the robotic vacuum cleaner 100 enters the mopping cloth separator 220 with the button portion 2227 pulled up, the robotic vacuum cleaner 100 may press down the pulled-up button portion 2227, allowing the pair of hooks 2223 to be deployed back outward of the receiving recess 22222.

Figure 15A:
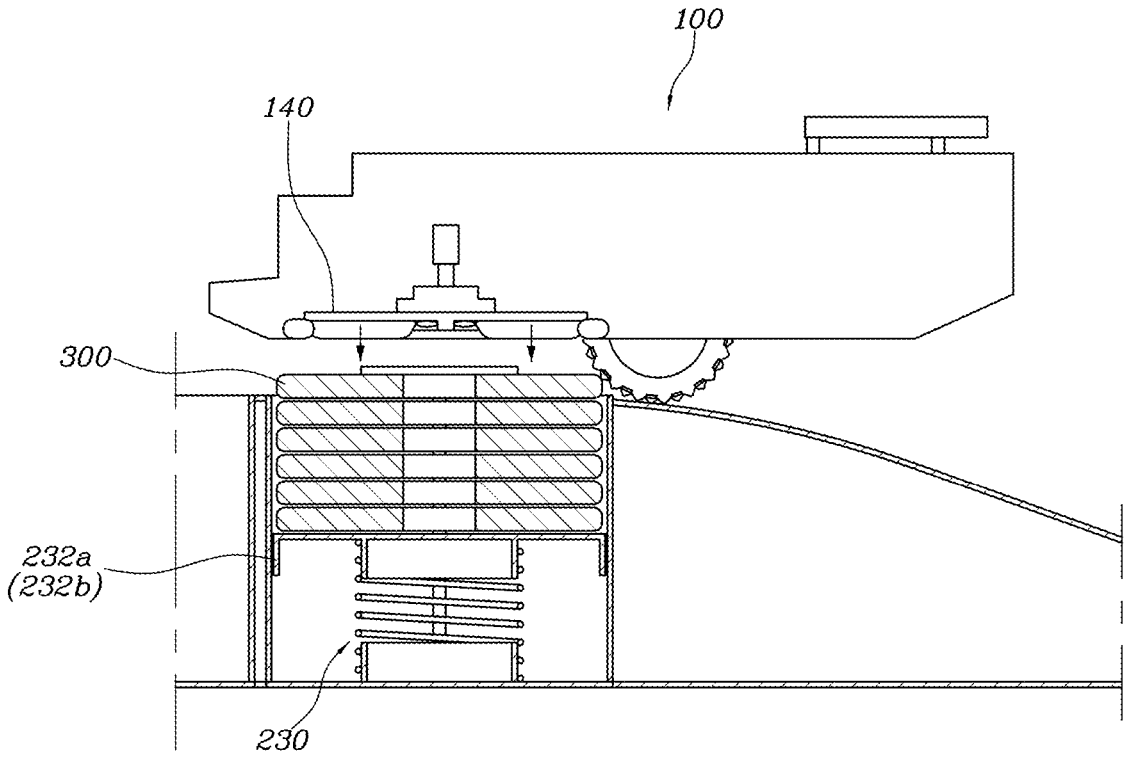
FIGS. 15A and 15B are side views illustrating a change in context when a mopping cloth is attached to a robotic vacuum cleaner in a mopping cloth coupler of a docking station according to an embodiment of the disclosure.
Figure 15B:
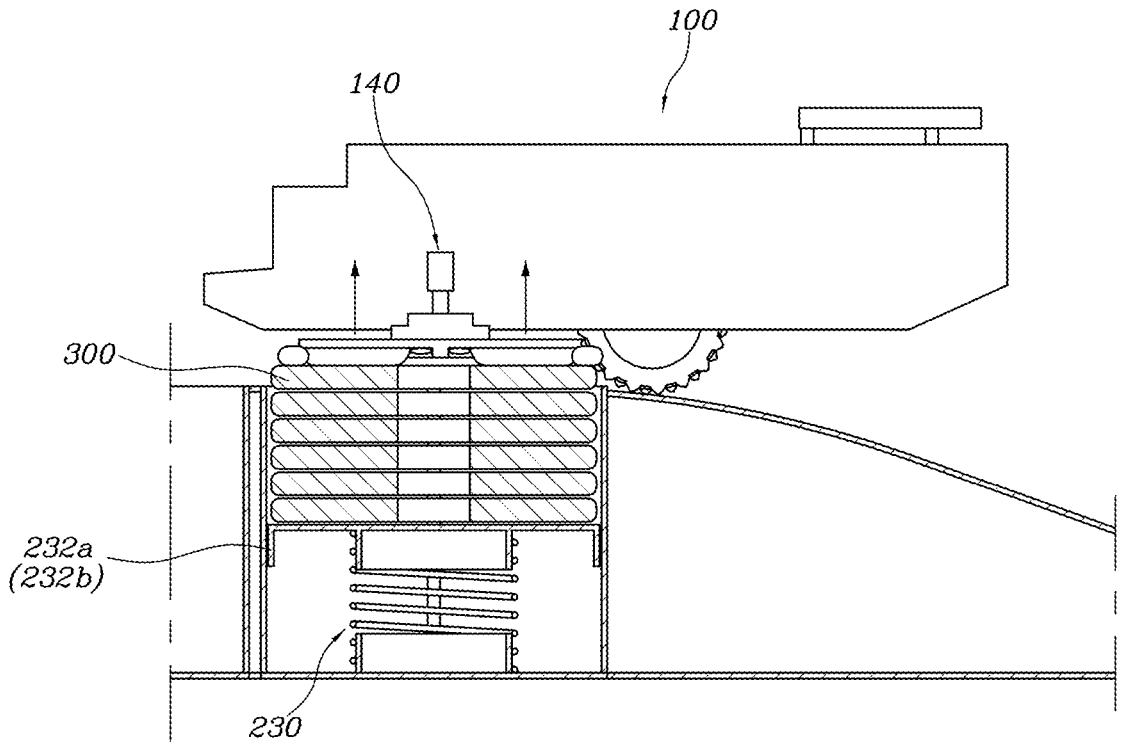

FIGS. 15A and 15B are side views illustrating a change in context when a mopping cloth is attached to a robotic vacuum cleaner in a mopping cloth coupler of a docking station according to an embodiment. For convenience of description, the internal cross section of the configuration of the mopping cloth coupler is shown.

As shown in FIG. 15A, in an embodiment, the robotic vacuum cleaner 100 is in a state of reaching an upper position of the mopping cloth coupler 230 with no mopping cloth 300 attached thereto. According to an embodiment, the robotic vacuum cleaner 100 may be in a state of having moved to the mopping cloth coupler 230 after separating the post-use mopping cloth 300 from the mopping cloth separator 220. According to an embodiment, the robotic vacuum cleaner 100 may detect the arrival at the correct position on the mopping cloth coupler 230.

Upon detecting arrival at the correct position on the mopping cloth coupler 230, the robotic vacuum cleaner 100 may control the driving unit 180 to move the mopping cloth unit 140 downward by a predetermined distance as shown in FIG. 15A. According to an embodiment, when the robotic vacuum cleaner 100 controls the driving unit to move the mopping cloth unit 140 downward, the mopping cloth unit 140 of the robotic vacuum cleaner 100 may contact the uppermost mopping cloth 300 among the pre-use mopping cloths 300 stacked in the mopping cloth tray 232*a* or 232*b* of the mopping cloth coupler 230. In an embodiment, the downward movement of the mopping cloth unit 140 may be performed within a range in which the mopping cloth unit 140 applies a force in a predetermined range to the mopping cloth underneath. The pre-use mopping cloth 300 contacting the mopping cloth unit 140 may be attached to the mopping cloth unit 140 by an attaching member provided on the lower surface of the mopping cloth unit 140.

Thereafter, as shown in FIG. 15B, if the robotic vacuum cleaner 100 controls the driving unit 180 to move the mopping cloth unit 140 upward, the pre-use mopping cloth 300 attached to the mopping cloth unit 140 escapes from the mopping cloth coupler 230, completing mopping cloth replacement by the robotic vacuum cleaner 100. Thereafter, the robotic vacuum cleaner 100 may be moved in the direction opposite to the entering direction to move away from the docking station 200 and resume cleaning according to the user's command.

Figure 16A:
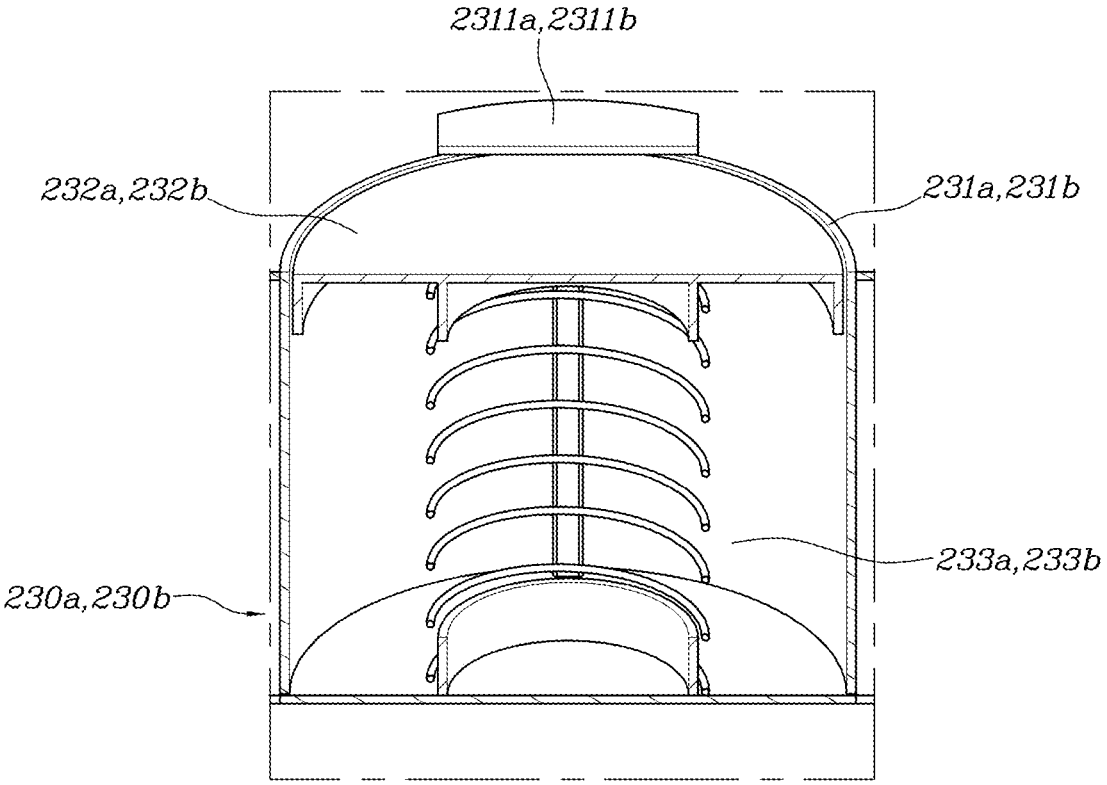
FIGS. 16A, 16B, and 16C are views illustrating a change in context when a mopping cloth is stacked and received before use in a mopping cloth coupler of a docking station according to an embodiment of the disclosure.
Figure 16B:
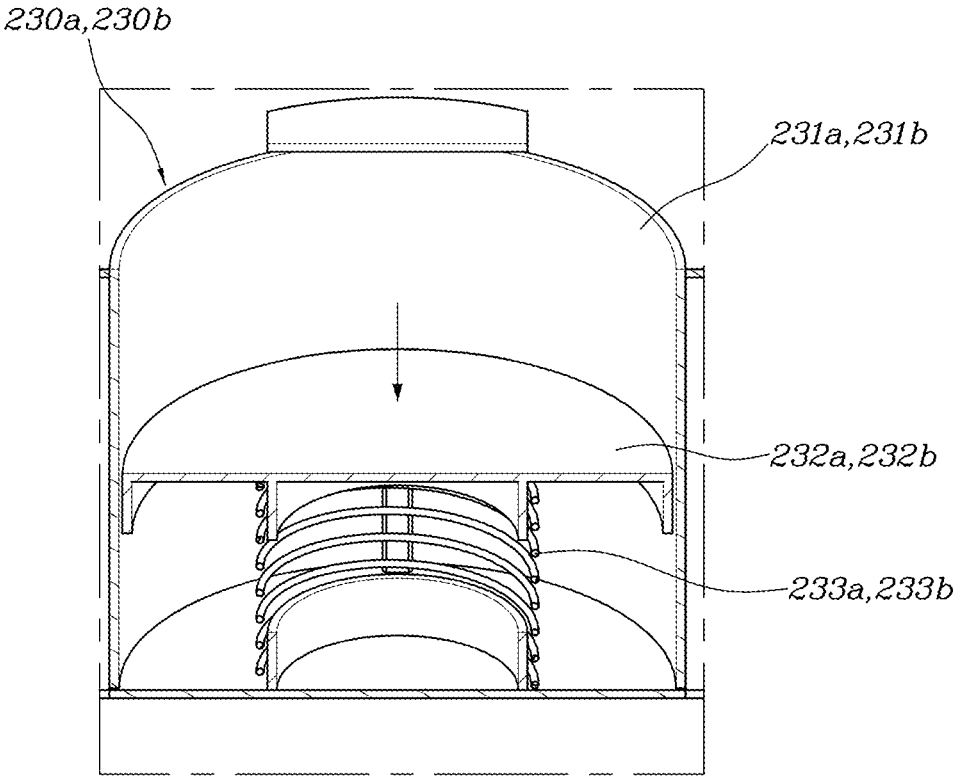
Figure 16C:
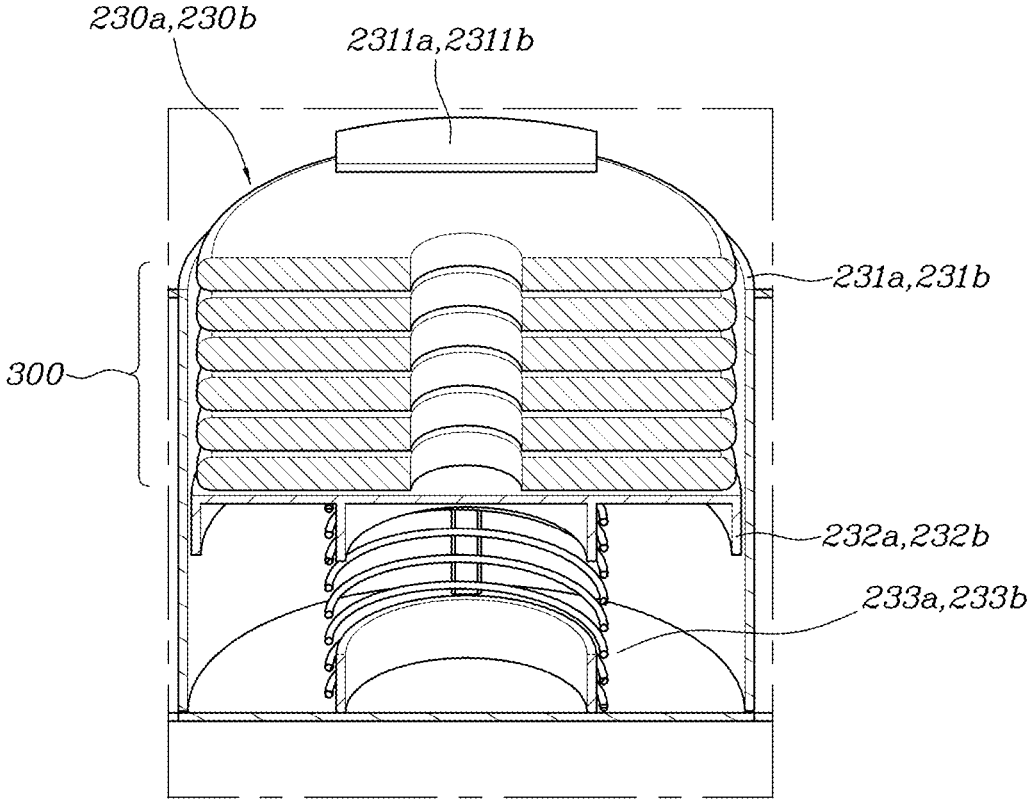

FIGS. 16A, 16B, and 16C are views illustrating a change in context when a mopping cloth is stacked and received before use in a mopping cloth coupler of a docking station according to an embodiment.

FIG. 16A illustrates the mopping cloth coupler 230*a* or 230*b* in an empty state with no pre-use mopping cloth 300 stacked. In this case, it can be seen that the mopping cloth tray 232*a* or 232*b* has been moved up to the height corresponding to the upper surface of the pre-use mopping cloth container 231*a* or 231*b* (or upper surface of the docking unit 212) by the elastic force of the mopping cloth support 233*a* or 233*b*.

Thereafter, if the user fills the mopping cloth coupler 230*a* or 230*b* with pre-use mopping cloths 300 one by one, the mopping cloth tray 232*a* or 232*b* may be pressed downward, compressing the mopping cloth support 233*a* or 233*b* as shown in FIG. 16C. If the mopping cloth support 233*a* or 233*b* is compressed, as shown in FIG. 16B, a space for receiving mopping cloths 300 may be formed inside the pre-use mopping cloth container 231*a* or 231*b*. An elastic force may be vertically applied to the sequentially stacked mopping cloths in the pre-use mopping cloth container 231*a* or 231*b* by the mopping cloth support 233*a* or 233*b* positioned thereunder. As described above, the mopping cloth rib 2311*a* or 2311*b* may be disposed on the pre-use mopping cloth container 231*a* or 231*b*, preventing the mopping cloth received in the mopping cloth container 231*a* or 231*b* from escaping outward of the mopping cloth coupler 230 by the elastic force from thereunder.

Figure 17:
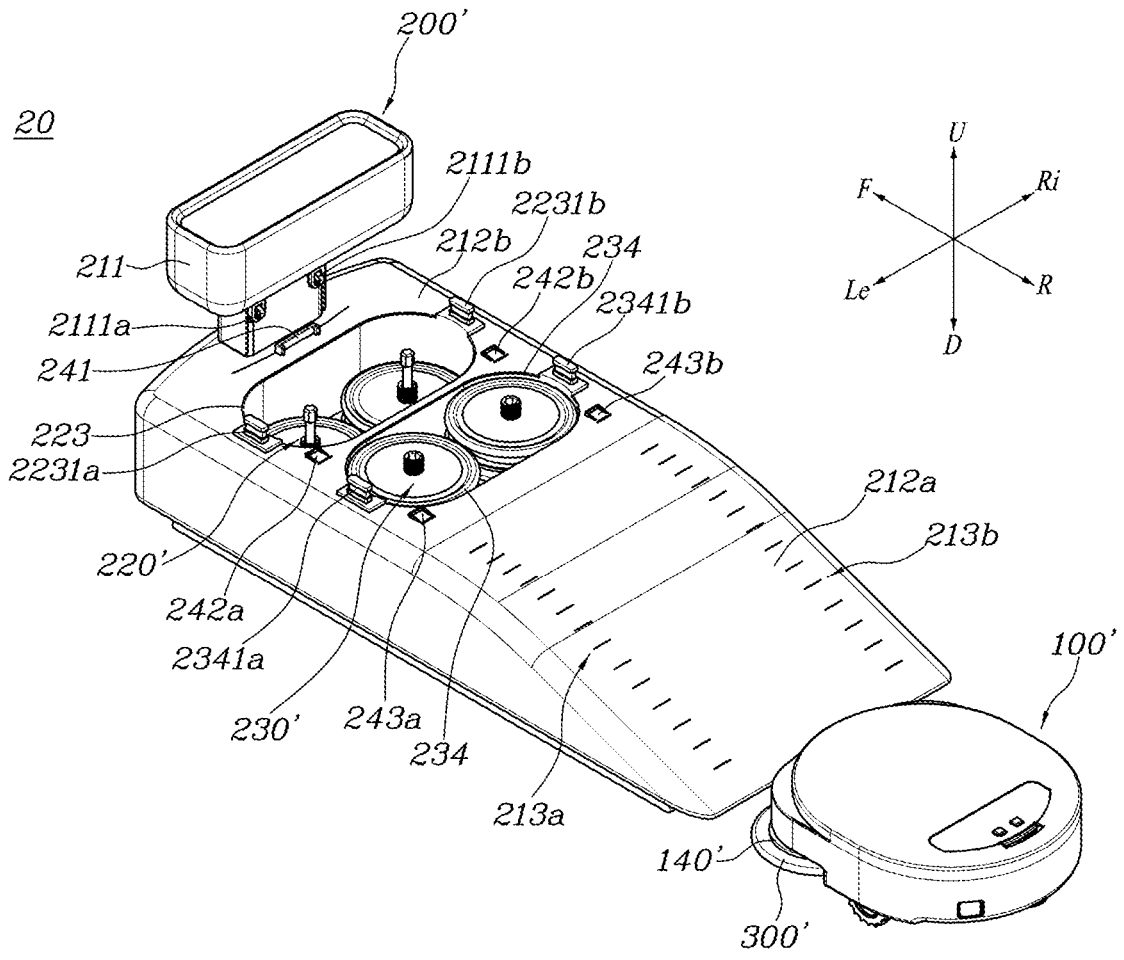
FIG. 17 is a view schematically illustrating a cleaning system according to an embodiment of the disclosure.

FIG. 17 is a view schematically illustrating a cleaning system according to an embodiment.

The cleaning system 20 shown in FIG. 17 may overall have an identical or similar configuration to the configuration of the cleaning system 10 described above in connection with FIG. 1 except for the configuration related to mopping cloth separation and mopping cloth coupling. Accordingly, in describing each component of the cleaning system 20, the description focuses primarily on parts different from those of the cleaning system 10 of FIG. 1, and the rest is omitted from the description.

Referring to FIG. 17, a cleaning system 20 according to an embodiment may include a robotic vacuum cleaner 100' and a docking station 200'. Like the robotic vacuum cleaner 100 and the docking station 200 described above in connection with FIG. 1, the robotic vacuum cleaner 100' may enter the docking station 200' to replace the mopping cloth 300' attached to the mopping cloth unit 140'. The robotic vacuum cleaner 100' may enter the docking station 200' for battery charging.

In an embodiment, the docking station 200' may include mopping cloth separators 220' that support to remove the mopping cloth 300' attached to the mopping cloth units 140' of the robotic vacuum cleaner 100' without a human intervention. In an embodiment, the docking station 200' may include mopping cloth couplers 230*a*' and 230*b*' that support to attach a new mopping cloth to the mopping cloth unit 140' of the robotic vacuum cleaner 100' without a human intervention. As shown, according to an embodiment, the mopping cloth separator 220' of the docking station 200' may be positioned downstream of the mopping cloth coupler 230' with respect to the traveling path of the robotic vacuum cleaner 100' entering the docking station 200' (i.e., upstream with respect to the traveling path of the robotic vacuum cleaner 100' exiting the docking station 200').

Figure 18:
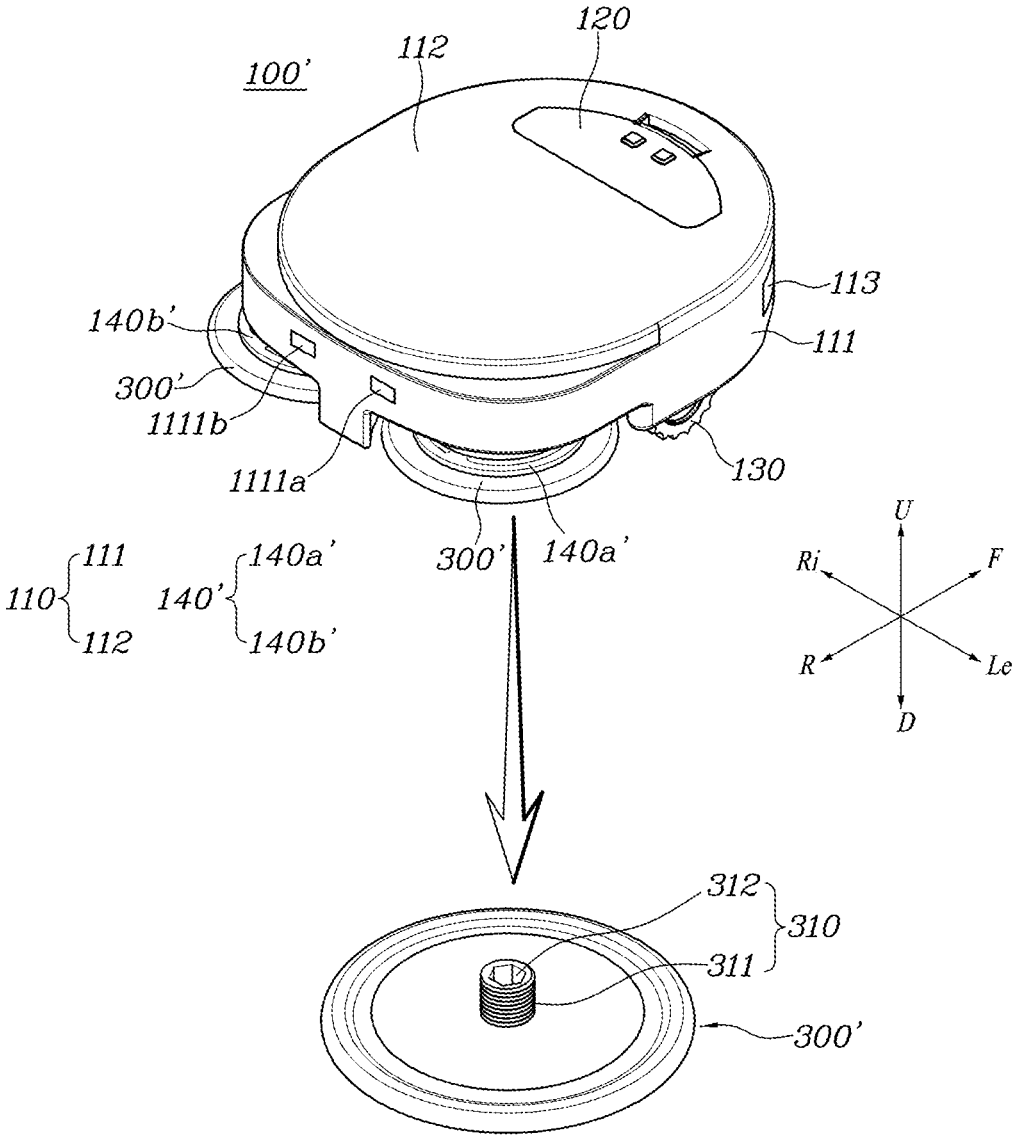
FIG. 18 is a perspective view illustrating a robotic vacuum cleaner according to an embodiment of the disclosure.
Figure 19:
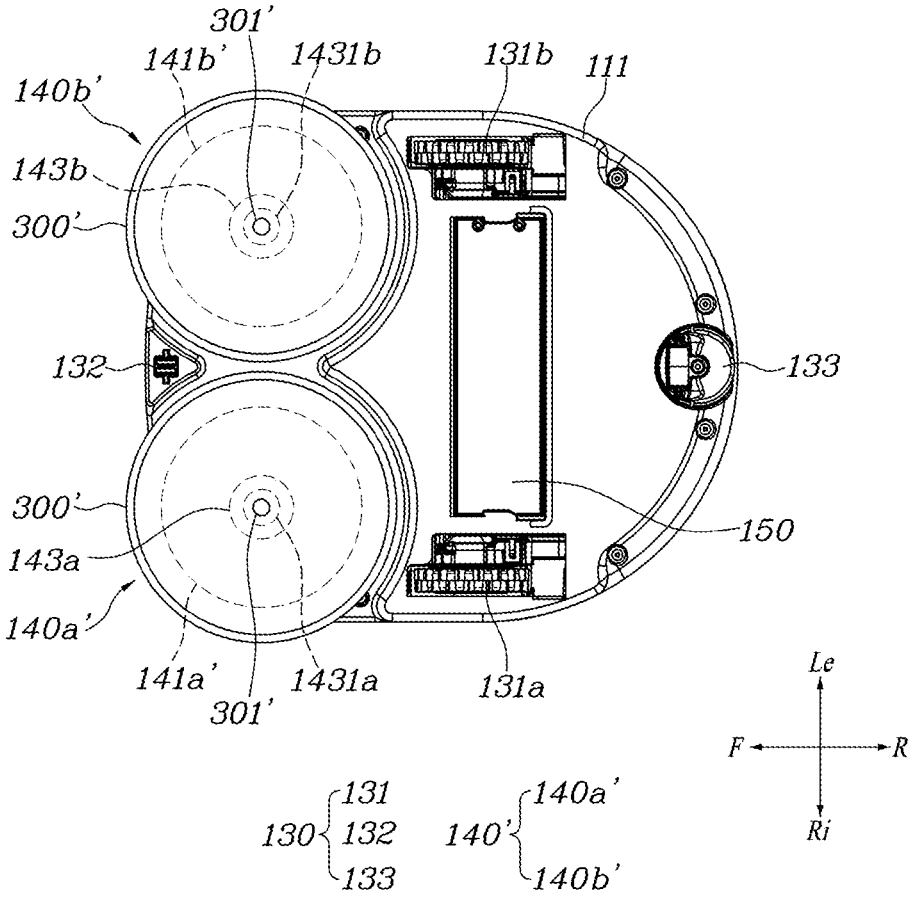
FIG. 19 is a bottom view illustrating a robotic vacuum cleaner according to an embodiment of the disclosure.

FIG. 18 is a perspective view illustrating a robotic vacuum cleaner according to an embodiment. FIG. 19 is a bottom view illustrating a robotic vacuum cleaner according to an embodiment.

The cleaning system 100' shown in FIGS. 18 and 19 may overall have an identical or similar configuration to the configuration of the cleaning system 100 described above in connection with FIGS. 2 and 3 except for the configuration related to mopping cloth separation and mopping cloth coupling. Accordingly, in describing each component of the cleaning system 20, the description focuses primarily on parts different from those of the cleaning system 100 of FIGS. 2 and 3, and the rest is omitted from the description.

Referring to FIGS. 18 and 19, in an embodiment, a mopping cloth 300' attachable to the robotic vacuum cleaner 100' may include a hole 301'. In an embodiment, each mopping cloth 300' may include a coupling portion 310 extending upward from the hole 301'. According to an embodiment, the coupling portion 310 may have a cylindrical pillar shape. According to an embodiment, the coupling portion 310 may be inserted into the hole 301' from above the mopping cloth 300' and coupled to the mopping cloth 300'. According to an embodiment, the coupling portion 310 may be provided integrally with the mopping cloth 300'. According to an embodiment, a thread 311 (e.g., a male thread) may be formed on the outer circumferential surface of the coupling portion 310. According to an embodiment, a hollow portion 312 may be formed inside the coupling portion 310. According to an embodiment, the cross-sectional shape of the hollow portion 312 may be a hexagon, but is not limited thereto. According to an embodiment, the inner circumferential surface of the hollow portion 312 may form an empty polygonal pillar shape.

Referring to FIGS. 18 and 19, in an embodiment, the robotic vacuum cleaner 100' may include a cleaner body 111' and a cleaner cover 112. As shown in FIGS. 18 and 19, in an embodiment, a pair of mopping cloth units 140*a*' and 140*b*' may be disposed on the lower surface of the cleaner body 111' of the robotic vacuum cleaner 100'. Like the robotic vacuum cleaner 100 of FIGS. 2 and 3, the mopping cloth 300' may be detachably coupled to each of the mopping cloth units 140'. The mopping cloth unit 140' may rotate together with the mopping cloth 300' attached thereto. In an embodiment, the mopping cloth units 140' may ascend or descend within a predetermined distance range in the height direction of the robotic vacuum cleaner 100' (e.g., direction perpendicular to the ground).

In an embodiment, the mopping cloth units 140' (e.g., the first mopping cloth unit 140*a*' and the second mopping cloth unit 140*b*') each may include a rotating plate (e.g., a first rotating plate 141*a*' or a second rotating plate 141*b*'). In an embodiment, the first and second rotating plates 141*a*' and 141*b*' may overall have a disc shape. However, embodiments of the disclosure are not limited thereto. According to an embodiment, mopping cloth fastening portions 143*a* and 143*b* may be disposed in the centers of the lower surfaces of the first and second rotating plates 141*a*' and 141*b*' of the robotic vacuum cleaner 100'. According to an embodiment, each of the mopping cloth fastening portions 143*a* and 143*b* may have an empty cylindrical concave portion. According to an embodiment, a thread 1431*a* or 1431*b* (e.g., a female thread) corresponding to the thread 311 formed on the outer circumferential surface of the coupling portion 310 of the mopping cloth 300 may be formed on the inner circumferential surface of the concave portion of each mopping cloth fastening portion 143*a* or 143*b*. In an embodiment, the robotic vacuum cleaner 100' may clean the floor surface by rotating the mopping cloth unit 140' in a state where the mopping cloth 300' is coupled. In an embodiment, the robotic vacuum cleaner 100' may separate the post-use mopping cloth 300 attached to the rotating plate 141' (specifically, attached to the mopping cloth fastening portion 143*a* or 143*b*) by rotating the mopping cloth unit 140' in a first direction (e.g., clockwise or counterclockwise) in a state in which the head portion 224 of the mopping cloth separator 220' is inserted in the hole 301' of post-use mopping cloth 300' coupled to the mopping cloth unit 140' as described below. In an embodiment, the robotic vacuum cleaner may couple the pre-use mopping cloth 300 to the mopping cloth unit 140' (specifically to the mopping cloth fastening portion 143*a* or 143*b*) by rotating the mopping cloth unit 140' in a second direction opposite to the first direction in a state in which the head portion 235 of the mopping cloth coupler 230' of the mopping cloth separator 220' is inserted in the hole 301' of the pre-use mopping cloth 300' as described below.

Figure 20:
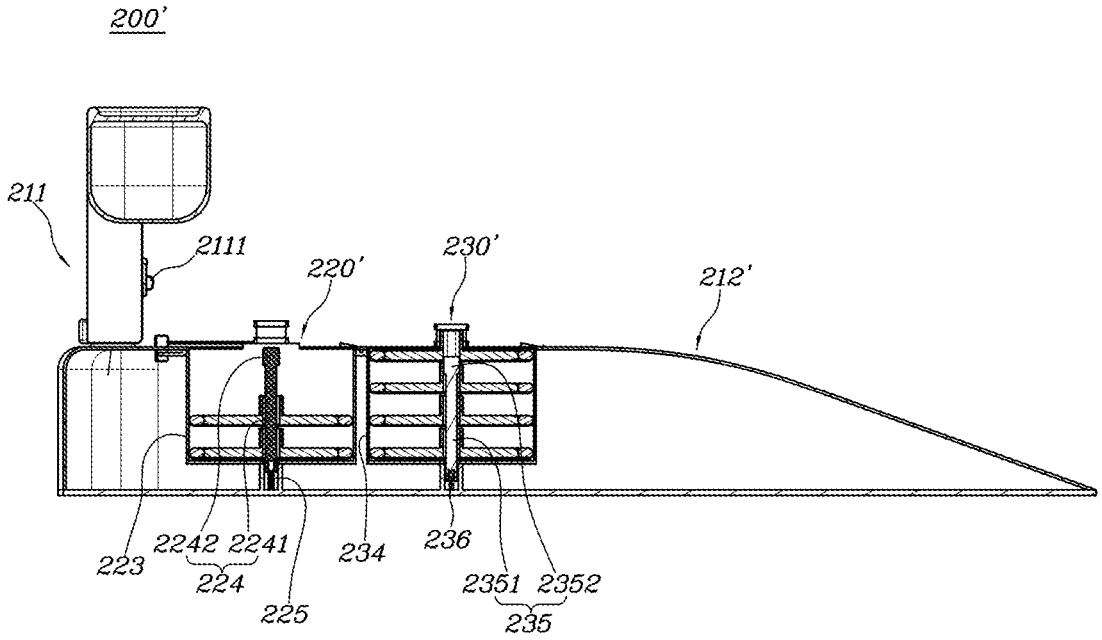
FIG. 20 is a cross-sectional view of a docking station as shown in FIG. 17, according to an embodiment of the disclosure.

FIG. 20 is a cross-sectional view of a docking station as shown in FIG. 17, according to an embodiment.

Referring to FIG. 20, in an embodiment, the docking station 200' may include a mopping cloth separator 220' and a mopping cloth coupler 230'. As described above, according to an embodiment, the mopping cloth separator 220' of the docking station 200' may be positioned downstream of the mopping cloth coupler 230' with respect to the traveling path of the robotic vacuum cleaner 100' entering the docking station 200' (i.e., upstream with respect to the traveling path of the robotic vacuum cleaner 100' exiting the docking station 200').

According to an embodiment, the mopping cloth separator 220' may include a post-use mopping cloth receiving space recessed downward from the upper surface of the docking unit 212'. According to an embodiment, the mopping cloth' separated from each mopping cloth separator 220' may be received in the respective corresponding post-use mopping cloth receiving space. According to an embodiment, the mopping cloth separator 220' may include a post-use mopping cloth container 223 received in the respective corresponding mopping cloth receiving space. According to an embodiment, the post-use mopping cloth container 223 may be shaped as an empty cylinder with a top opening, but the disclosure is not limited thereto.

According to an embodiment, similar to the post-use mopping cloth container 221 described above in connection with FIGS. 5 and 6, the post-use mopping cloth container 223 may vertically stack and receive one or more mopping cloths 300' separated from the robotic vacuum cleaner 100'. Each mopping cloth 300' received in the post-use mopping cloth container 223 may include a hole 301' and a coupling portion 310 protruding and extending from the hole 301' as described above in connection with FIG. 18. According to an embodiment, similar to the pre-use mopping cloth container 221 as described above in connection with FIGS. 5 and 6, the post-use mopping cloth container 223 may be disposed to be separated from the docking station 200' but is not limited thereto.

According to an embodiment, the mopping cloth separator 220' may include a head portion 224 and an elastic support 225.

According to an embodiment, the head portion 224 may include a body portion 2241 extending upward and an insertion protrusion 2242 formed at an end of the body portion 2241 and having a cross-sectional shape corresponding to the cross-sectional shape of the hollow portion 312.

According to an embodiment, the body portion 2241 of the head portion 224 may extend vertically from the bottom surface (e.g., the portion recessed deepest from the upper surface of the docking unit 212') of each mopping cloth receiving space formed in each mopping cloth separator 220'. According to an embodiment, the body portion 2241 may be disposed on the bottom surface of the post-use mopping cloth container 223 received in each mopping cloth receiving space and extend upward.

According to an embodiment, the insertion protrusion 2242 of the head portion 224 may have a shape corresponding to the inner circumferential surface of the hollow portion 312 of the above-described mopping cloth 300'. According to an embodiment, the insertion protrusion 2242 may have a polygonal pillar shape. According to an embodiment, the head portion 224 disposed in each mopping cloth separator 220', specifically, the insertion protrusion 2242 of the head portion 224, may be inserted into the hollow portion 312 of the mopping cloth 300' when the mopping cloth 300' coupled to the robotic vacuum cleaner 100' is separated. According to an embodiment, to separate the mopping cloth 300' coupled to the robotic vacuum cleaner 100', the mopping cloth unit 140' (or rotating plate 141') of the robotic vacuum cleaner 100 may be rotated in a predetermined direction. According to an embodiment, when the mopping cloth unit 140' (or rotating plate 141') of the robotic vacuum cleaner 100' is rotated in the predetermined direction, the insertion protrusion 2242 inserted into the hollow portion 312 may play a role to fix the mopping cloth 300' not to rotate along with the mopping cloth unit 140' (or rotating plate 141'). In an embodiment, as the mopping cloth unit 140' (or rotating plate 141') of the robotic vacuum cleaner 100' is rotated with the mopping cloth 300' fixed, the screw engagement between the mopping cloth coupler of the robotic vacuum cleaner 100' and the coupling portion 310 of the mopping cloth 300' may be released, so that the mopping cloth 300' may be separated from the robotic vacuum cleaner 100'. As such, after the insertion protrusion 2242 is inserted into the hollow portion 312 of the coupling portion 310 of the mopping cloth 300' coupled to the robotic vacuum cleaner 100', the head portion 224 may apply a force that resists the force (e.g., rotational force) applied to the mopping cloth 300 from the robotic vacuum cleaner 100 to the mopping cloth 300' to separate the mopping cloth 300' from the robotic vacuum cleaner 100'.

According to an embodiment, an elastic support 225 may be disposed at a lower end of the head portion 224. According to an embodiment, the elastic support 225 may transfer elastic force in a vertical direction to the head portion 224 so that the head portion 224 may move up and down.

Although not shown in the drawings, in an embodiment, the lower end of the head portion 224 may be connected to an actuator (not shown). In this case, the head portion 224 may ascend or descend according to the operation of an actuator (not shown), but the disclosure is not limited thereto.

According to an embodiment, the mopping cloth coupler may supply the mopping cloth to be mounted on the robotic vacuum cleaner 100' from a lower end of the docking station 200'. According to an embodiment, the mopping cloth coupler 230' may include a pre-use mopping cloth receiving space recessed downward from the upper surface of the docking unit 212'. According to an embodiment, in each mopping cloth coupler 230', each of one or more mopping cloths 300' to be supplied to the robotic vacuum cleaner 100' may be received in a respective corresponding pre-use mopping cloth receiving space. According to an embodiment, the mopping cloth coupler 230' may include a pre-use mopping cloth container 234 received in the respective corresponding mopping cloth receiving space. According to an embodiment, the pre-use mopping cloth container 234 may be shaped as an empty cylinder with a top opening, but the disclosure is not limited thereto.

According to an embodiment, the mopping cloth coupler 230' may include a pre-use mopping cloth container 234, a head portion 235, and an elastic support 236. According to an embodiment, the pre-use mopping cloth container 234, the head portion 235, and the elastic support 236 of the mopping cloth coupler 230' respectively may correspond in operation, structure, and shape to the post-use mopping cloth container 223, the head portion 224, and the elastic support 225 of the mopping cloth separator 220'. In this case, the description of the post-use mopping cloth container 223, the head portion 224, and the elastic support 225 of the mopping cloth separator 220' may apply likewise to the pre-use mopping cloth container 234, the head portion 235, and the elastic support 236 of the mopping cloth coupler 230'.

According to an embodiment, the mopping cloth coupler 230' may include a head portion 235 and an elastic support 236. According to an embodiment, the head portion 235 may include a body portion 2351 extending upward and an insertion protrusion 2352 formed at an end of the body portion 2351 and having a cross-sectional shape corresponding to the cross-sectional shape of the hollow portion 312 of the mopping cloth 300'. According to an embodiment, the body portion 2351 of the head portion 235 may extend vertically from the bottom surface (e.g., the portion recessed deepest from the upper surface of the docking unit 212') of each mopping cloth receiving space formed in each mopping cloth coupler 230'. According to an embodiment, the body portion 2351 may be disposed on the bottom surface of the pre-use mopping cloth container 234 received in each mopping cloth receiving space and extend upward. According to an embodiment, the insertion protrusion 2352 of the head portion 235 may have a shape corresponding to the inner circumferential surface of the hollow portion 312 of the above-described mopping cloth 300'. According to an embodiment, the insertion protrusion 2352 may have a polygonal pillar shape.

According to an embodiment, an elastic support 236 may be disposed at a lower end of the head portion 235. According to an embodiment, the elastic support 236 may transfer elastic force in a vertical direction to the head portion 235 so that the head portion 235 may move up and down. Although not shown in the drawings, in an embodiment, the lower end of the head portion 235 may be connected to an actuator (not shown). In this case, the head portion 235 may ascend or descend according to the operation of an actuator (not shown), but the disclosure is not limited thereto.

As illustrated in FIG. 20, according to an embodiment, a plurality of pre-use mopping cloths 300' received in the pre-use mopping cloth container 234 may be sequentially stacked in a vertical direction. According to an embodiment, each of the plurality of pre-use mopping cloths 300' received in the pre-use mopping cloth container 234 may be disposed with the head portion 224 penetrating the hollow portion 312 of the mopping cloth 300'.

Figure 21A:
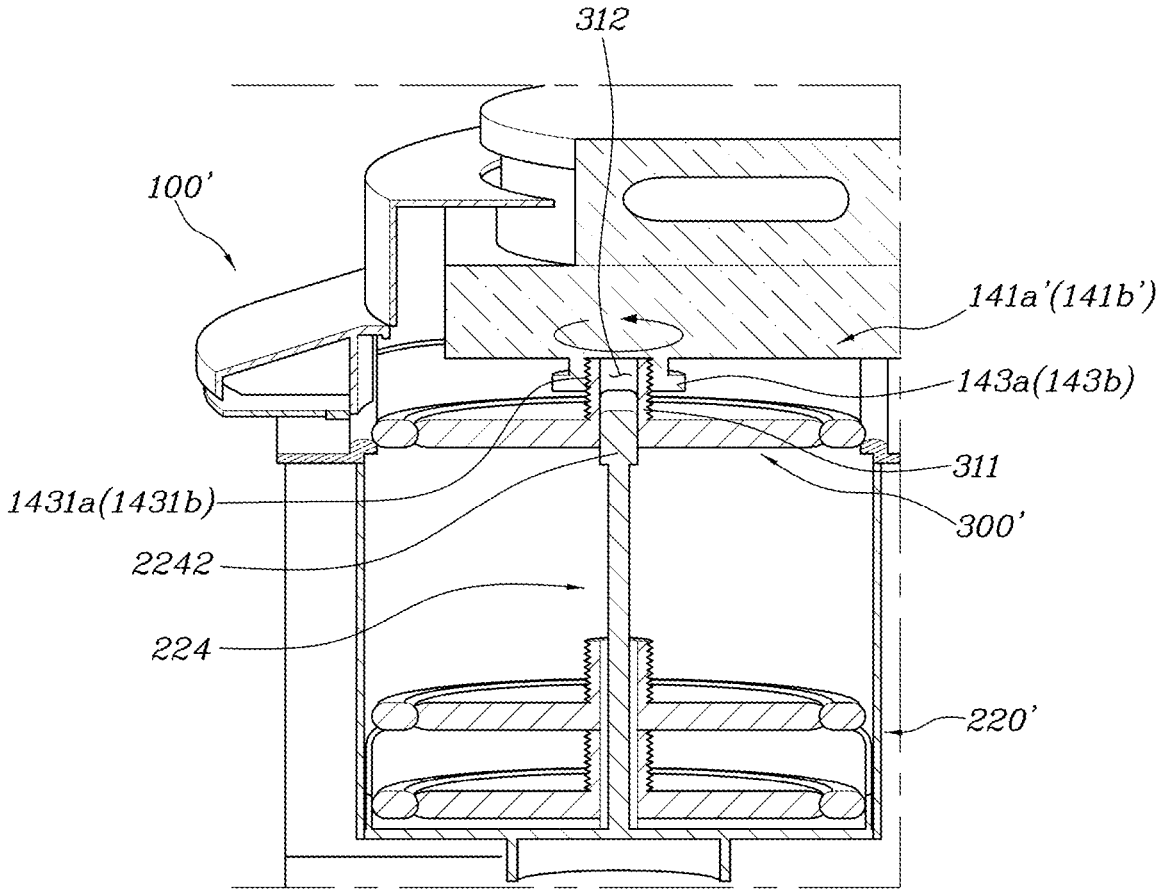
FIGS. 21A and 21B are views illustrating an example process of detaching a mopping cloth attached to a robotic vacuum cleaner in a mopping cloth separator of a docking station according to an embodiment of the disclosure.
Figure 21B:
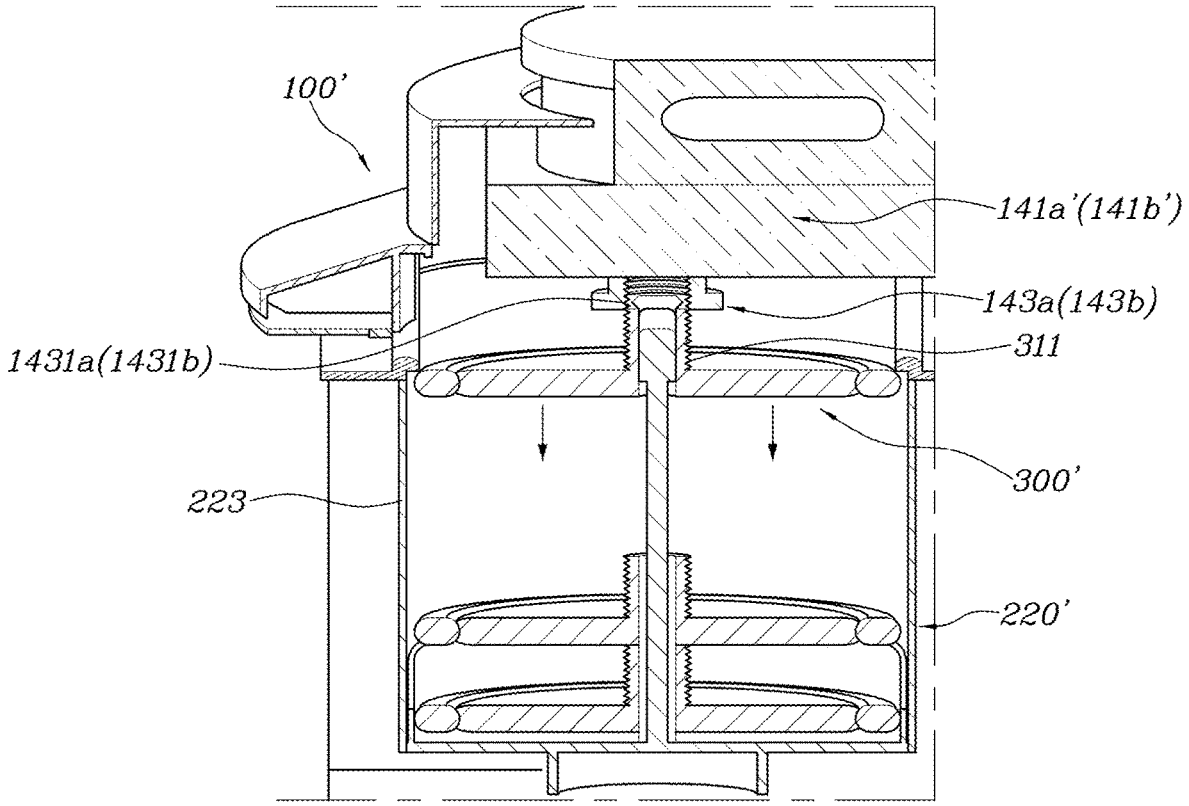

FIGS. 21A and 21B are views illustrating an example process of detaching a mopping cloth attached to a robotic vacuum cleaner in a mopping cloth separator of a docking station according to an embodiment.

Referring to FIG. 21A, the robotic vacuum cleaner 100' may be in a state of having reached an upper position of the mopping cloth separator 220' with the mopping cloth 300' attached thereto. According to an embodiment, when the robotic vacuum cleaner 100' reaches a correct position above the mopping cloth separator 220, the insertion protrusion 2242 of the head portion 224 of the mopping cloth separator 220' may be inserted into the hollow portion 312 of the mopping cloth 300' coupled to the robotic vacuum cleaner 100'. Thereafter, when the robotic vacuum cleaner 100' controls the driving unit to rotate the rotating plate 141' in a predetermined direction, the insertion protrusion 2242 may apply a force resisting rotation of the rotating plate 141' to the mopping cloth 300' to fix the mopping cloth 300' without rotating together with the rotating plate 141'. According to an embodiment, when the rotating plate 141' is rotated with the mopping cloth 300' fixed, engagement between the thread 1431*a* or 1431*b* provided in the mopping cloth fastening portion 143*a* or 143*b* of the robotic vacuum cleaner 100' and the thread 311 formed on the outer circumferential surface of the coupling portion 310 of the mopping cloth 300' may be released, so that the mopping cloth 300' may fall downward. Accordingly, as shown in FIG. 21B, the mopping cloth 300' coupled to the rotating plate 141' of the robotic vacuum cleaner 100' may be separated from the robotic vacuum cleaner 100', and the separated mopping cloth 300' may be sequentially stacked in the post-use mopping cloth container 223 with the head portion 224 penetrating the hole 301'.

Meanwhile, according to an embodiment of the disclosure, the mopping cloth coupler 230' may couple the pre-use mopping cloth 300' to the robotic vacuum cleaner 100' through a similar process to the process of separating the post-use mopping cloth 300' from the mopping cloth separator 220' as described above in connection with FIGS. 21A and 21B.

According to an embodiment, when the robotic vacuum cleaner 100' reaches the correct position above the mopping cloth coupler 230', the uppermost mopping cloth 300' among the pre-use mopping cloths 300' received in the pre-use mopping cloth container 234 may be inserted to the mopping cloth fastening portion 143 of the mopping cloth unit 140' of the robotic vacuum cleaner 100'. According to an embodiment, the coupling portion 310 of the uppermost mopping cloth 300' received in the pre-use mopping cloth container 234 may be inserted to the mopping cloth fastening portion 143 of the robotic vacuum cleaner 100'. In this case, the insertion protrusion 2242 of the head portion 235 may be in a state of having been inserted in the inside (e.g., the hollow portion 312) of the coupling portion 310 of the mopping cloth 300'. According to an embodiment, when the robotic vacuum cleaner 100' controls the driving unit to rotate the rotating plate 141' in a predetermined rotation direction (direction opposite to the above-described rotation direction for mopping cloth separation), the insertion protrusion 2342 may apply a force resisting rotation of the rotating plate 141' to the mopping cloth 300' to fix the mopping cloth 300' without rotating together with the rotating plate 141'. According to an embodiment, when the rotating plate 141' is rotated with the mopping cloth 300' fixed, the thread 1431*a* or 1431*b* provided in the mopping cloth fastening portion 143 of the robotic vacuum cleaner 100' and the thread 311 formed on the outer circumferential surface of the coupling portion 310 of the mopping cloth 300' may be engaged with each other, so that the mopping cloth 300' may be coupled to the mopping cloth fastening portion 143. Thereafter, the insertion protrusion 2242 may be removed from the hollow portion 312 of the mopping cloth 300', and the mopping cloth coupling process is complete. According to an embodiment, the insertion protrusions 2242 and 2352 of the head portions 224 and 235 respectively provided in the mopping cloth separator 220' and the mopping cloth coupler 230' of the docking station 200' may have a proper shape and size to be smoothly inserted into the hollow portion 312 of the coupling portion 310 of the mopping cloth 300' and to prevent the mopping cloth 300' from rotating together when an external force to rotate the mopping cloth 300' is applied.

The terms as used herein are provided merely to describe some embodiments thereof, but are not intended to limit the disclosure. As used herein, the singular forms "a," "an," and "the" are intended to include the plural forms as well, unless the context clearly indicates otherwise. As used herein, each of such phrases as "A or B," "at least one of A and B," "at least one of A or B," "A, B, or C," "at least one of A, B, and C," and "at least one of A, B, or C," may include all possible combinations of the items enumerated together in a corresponding one of the phrases. As used herein, the term 'and/or' should be understood as encompassing any and all possible combinations by one or more of the enumerated items. As used herein, the terms "include," "have," and "comprise" are used merely to designate the presence of the feature, component, part, or a combination thereof described herein, but use of the term does not exclude the likelihood of presence or adding one or more other features, components, parts, or combinations thereof. As used herein, the terms "first" and "second" may modify various components regardless of importance and/or order and are used to distinguish a component from another without limiting the components.

As used herein, the terms "configured to" may be interchangeably used with the terms "suitable for," "having the capacity to," "designed to," "adapted to," "made to," or "capable of" depending on circumstances. The term "configured to" does not essentially mean "specifically designed in hardware to." Rather, the term "configured to" may mean that a device can perform an operation together with another device or parts. For example, a 'device configured (or set) to perform A, B, and C' may be a dedicated device to perform the corresponding operation or may mean a general-purpose device capable of various operations including the corresponding operation.

Meanwhile, the terms "upper side", "lower side", and "front and rear directions" used in the disclosure are defined with respect to the drawings, and the shape and position of each component are not limited by these terms.

In the disclosure, the above-described description has been made mainly of specific embodiments, but the disclosure is not limited to such specific embodiments, but should rather be appreciated as covering all various modifications, equivalents, and/or substitutes of various embodiments.

What is claimed is:

1. A docking station, comprising:

a docking unit providing a traveling path for a robotic vacuum cleaner, having a mounted mopping cloth, that enters the docking unit;

a mopping cloth separator disposed on the docking unit and configured to automatically separate the mounted mopping cloth from the robotic vacuum cleaner while the robotic vacuum cleaner is at a first position along the traveling path; and a mopping cloth coupler disposed on the docking unit and configured so that, after the mounted mopping cloth is separated from the robotic vacuum cleaner, and the robotic vacuum cleaner thereafter moves to a second position along the traveling path, the mopping cloth coupler supplies a mopping cloth to be mounted to the robotic vacuum cleaner from below the traveling path while the robotic vacuum cleaner is at the second position.

2. The docking station of claim 1, wherein the mounted mopping cloth and the mopping cloth supplied by the mopping cloth coupler each includes a hole, and the mopping cloth separator includes:

a separation structure configured to:

pass through the hole of the mounted mopping cloth mounted to the robotic vacuum cleaner, and apply a force to the mounted mopping cloth, against a force applied to the mounted mopping cloth from the robotic vacuum cleaner, to separate the mounted mopping cloth from the robotic vacuum cleaner, and a mopping cloth container recessed from an upper surface of the docking unit and configured to receive the separated mopping cloth, wherein the separation structure extends from a bottom surface of the mopping cloth container.

3. The docking station of claim 2, wherein the separation structure is configured to maintain a state in which the separation structure is extended through the hole of the separated mopping cloth while the separated mopping cloth is received in the mopping cloth container.

4. The docking station of claim 2, wherein the separation structure includes:

a body portion having at least a portion configured to pass through the hole of the mounted mopping cloth, and a pair of hooks connected to the body portion so as to be rotatable, wherein each of the hooks includes:

a connection portion connected to the body portion, and a free end opposite to the connection portion, wherein the free ends are configured to be rotated downward to approach each other to be folded in an inactive state when an external force is applied to the free ends toward the bottom surface of the mopping cloth container, and moved away from each other by an elastic force when the external force is removed, so as to be unfolded and restored to an active state.

5. The docking station of claim 4, wherein the separation structure includes a button configured to adjust the pair of hooks to the active state or the inactive state, and when the pair of hooks are adjusted to the inactive state by manipulation of the button, the pair of hooks are configured to maintain the inactive state without application of an additional external force.

6. The docking station of claim 2, wherein the separation structure includes:

a first body portion configured with a first thread formed on an upper outer circumferential surface, and a second body portion including a hollow portion configured with a second thread formed on an inner circumferential surface of the hollow portion, wherein at least part of the first body portion is inserted in the hollow portion of the second body portion so that the second thread is screwed onto the first thread.

7. The docking station of claim 2, wherein the mopping cloth supplied by the mopping cloth coupler includes a coupling portion extending upward from the hole, the coupling portion has a polygonal shaped inner circumferential surface passing therethrough, and at least one of the mopping cloth separator and the mopping cloth coupler includes a polygonal shaped head portion corresponding to the polygonal shaped inner circumferential surface of the coupling portion such that at least a part of the polygonal shaped head portion is insertable into the coupling portion through the hole.

8. The docking station of claim 7, wherein at least one of the mopping cloth separator and the mopping cloth coupler includes an elastic support configured to provide a vertical elastic force to the polygonal shaped head portion.

9. The docking station of claim 1, wherein the mopping cloth coupler includes:

a receiving space recessed from an upper surface of the docking unit and configured so that one or more mopping cloths are stackable inside the receiving space, and a mopping cloth support disposed at a lower side of the receiving space and configured to push upward on the one or more mopping cloths in the receiving space.

10. The docking station of claim 9, wherein the mopping cloth coupler includes a fixing member disposed on the upper surface of the docking unit and configured to limit an uppermost height of the one or more mopping cloths in the receiving space being pushed upward by the mopping cloth support.

11. A cleaning system comprising a robotic vacuum cleaner and a docking station, wherein the robotic vacuum cleaner including:

a mopping cloth unit to which a mopping cloth is mountable; and wherein the docking station including:

a docking unit providing a traveling path for the robotic vacuum cleaner, having a mopping cloth mounted to the mopping cloth unit, that enters the docking unit;

a mopping cloth separator disposed on the docking unit and configured to automatically separate the mopping cloth mounted to the mopping cloth unit while the robotic vacuum cleaner is at a first position along the traveling path; and a mopping cloth coupler disposed on the docking unit and configured so that, after the mopping cloth is separated from the mopping cloth unit, and the robotic vacuum cleaner thereafter moves to a second position along the traveling path, the mopping cloth coupler supplies a mopping cloth to be mounted to the mopping cloth unit from below the traveling path while the robotic vacuum cleaner is at the second position.

12. The cleaning system of claim 11, wherein the mounted mopping cloth and the mopping cloth supplied by the mopping cloth coupler each includes a hole, and the mopping cloth separator includes:

a separation structure configured to:

pass through the hole of the mounted mopping cloth mounted to the robotic vacuum cleaner, and apply a force to the mounted mopping cloth, against a force applied to the mounted mopping cloth from the robotic vacuum cleaner, to separate the mounted mopping clot from the robotic vacuum cleaner, and a mopping cloth container recessed from an upper surface of the docking unit and configured to receive the separated mopping cloth, wherein the separation structure extends from a bottom surface of the mopping cloth container.

13. The cleaning system of claim 12, wherein the force applied to the mounted mopping cloth from the robotic vacuum cleaner is generated by upward/downward movement or rotation of the mopping cloth unit.

14. The cleaning system of claim 12, wherein the mopping cloth supplied by the mopping cloth coupler includes a coupling portion extending upward from the hole, the coupling portion has a polygonal shaped inner circumferential surface passing therethrough, and at least one of the mopping cloth separator and the mopping cloth coupler includes a polygonal shaped head portion corresponding to the polygonal shaped inner circumferential surface of the coupling portion such that at least a part of the polygonal shaped head portion is insertable into the coupling portion through the hole.

15. The cleaning system of claim 14, wherein the coupling portion includes a thread formed on an outer circumferential surface, and the mopping cloth unit is configured to be rotatable and includes a mopping cloth fastening portion provided with an inner circumferential surface having a thread corresponding to the thread of the coupling portion so that the mopping cloth fastening portion is couplable to the coupling portion.

16. The cleaning system of claim 15, wherein the mopping cloth separator and the mopping cloth unit are configured so that, when the robotic vacuum cleaner is at the first position along the traveling path, the head portion of the mopping cloth separator is insertable into the hole of the mounted mopping cloth, and the mopping cloth unit is rotatable in a first rotation direction so as to release engagement between the coupling portion of the mopping cloth and the mopping cloth fastening portion, and the mopping cloth coupler and the mopping cloth unit are configured so that, when the robotic vacuum cleaner is at the second position along the traveling path after having the mounted mopping cloth separated from the robot vacuum cleaner at the first position along the traveling path, the head portion of the mopping cloth coupler is insertable into the hole of the mopping cloth supplied by the mopping cloth coupler, and the mopping cloth unit is rotatable in a second rotation direction opposite to the first rotation direction to engage the coupling portion of a mopping cloth in the mopping cloth coupler with the mopping cloth fastening portion.

17. A robotic vacuum cleaner, comprising:

a mopping cloth unit configured to mount a mopping cloth to the mopping cloth unit;

a replacement determination unit configured to determine whether it is a time to replace a mopping cloth mounted to the mopping cloth unit;

a travel driving unit configured to drive the robotic vacuum cleaner to travel along a traveling path;

a rotate driving unit configured to rotate the mopping cloth unit;

an up/down driving unit configured to move the mopping cloth unit upward/downward; and a controller configured to, while a mopping cloth is mounted to the mopping cloth unit, upon determining by the replacement determination unit that it is the time to replace the mopping cloth mounted to the mopping cloth unit, control the travel driving unit to move the robotic vacuum cleaner to a first position along the traveling path, control at least one of the rotate driving unit and the up/down driving unit while the robotic vacuum cleaner is in the first position to separate the mopping cloth mounted to the mopping cloth unit from the mopping cloth unit, after the mopping cloth is separated from the mopping cloth unit, control the traveling driving unit to move the robotic vacuum cleaner to a second position along the traveling path, and control at least one of the rotate driving unit and the up/down driving unit while the robotic vacuum cleaner is in the second position to mount another mopping cloth to the mopping cloth unit, wherein, to travel to the first position, the robotic vacuum cleaner travels through the second position.

18. The robotic vacuum cleaner of claim 17, wherein the mopping cloth mounted to the mopping cloth unit and the another mopping cloth each includes a hole, and the controller is configured to, upon detecting arrival of the robotic vacuum cleaner at the first position, control the up/down driving unit to move the mopping cloth unit downward so that at least a portion of a structure installed in the first position passes through the hole of the mopping cloth mounted to the mopping cloth unit, and then move the mopping cloth unit upward to separate the mopping cloth mounted to the mopping cloth unit from the mopping cloth unit, and upon detecting arrival of the robotic vacuum cleaner at the second position after having the mounted mopping cloth separated from the mopping cloth unit, control the up/down driving unit to move the mopping cloth unit downward by a predetermined distance so as to mount the another mopping cloth on the mopping cloth unit.

19. The robotic vacuum cleaner of claim 17, wherein the mopping cloth mounted to the mopping cloth unit and the another mopping cloth each includes a hole and a coupling portion extending upward from the hole, the coupling portion has an outer circumferential surface with a thread formed thereon, the mopping cloth unit includes a mopping cloth fastening portion having a hollow cylindrical shape with an inner circumferential surface with a thread formed thereon and corresponding to the outer circumferential surface of the coupling portion of the mopping cloth, and the controller is configured to, upon detecting arrival of the robotic vacuum cleaner at the first position, control the rotate driving unit to rotate the mopping cloth unit in a first rotation direction to disengage the mopping cloth unit from the mopping cloth mounted on the mopping cloth unit, and upon detecting arrival of the robotic vacuum cleaner at the second position after having the mounted mopping cloth separated from the mopping cloth unit, control the rotate driving unit to rotate the mopping cloth unit in a second rotation direction opposite to the first rotation direction to engage the mopping cloth unit to the another mopping cloth.

20. The robotic vacuum cleaner of claim 17, further comprising:

a charging terminal, wherein the controller is configured to control charging of the robotic vacuum cleaner through the charging terminal while the robotic vacuum cleaner is in the first position.

* * * * *